US010726856B2

(12) United States Patent
Le Roux et al.

(10) Patent No.: US 10,726,856 B2
(45) Date of Patent: Jul. 28, 2020

(54) METHODS AND SYSTEMS FOR ENHANCING AUDIO SIGNALS CORRUPTED BY NOISE

(71) Applicant: Mitsubishi Electric Research Laboratories, Inc., Cambridge, MA (US)

(72) Inventors: Jonathan Le Roux, Arlington, MA (US); Shinji Watanabe, Baltimore, MD (US); John Hershey, Winchester, MA (US); Gordon Wichern, Boston, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 161 days.

(21) Appl. No.: 15/998,765

(22) Filed: Aug. 16, 2018

(65) Prior Publication Data

US 2020/0058314 A1 Feb. 20, 2020

(51) Int. Cl.

| | |
|---|---|
| ***G10L 21/02*** | (2013.01) |
| ***G10L 19/032*** | (2013.01) |
| ***G10L 21/0272*** | (2013.01) |
| *G10L 19/00* | (2013.01) |

(52) U.S. Cl.

CPC ..... *G10L 21/02* (2013.01); *G10L 19/032* (2013.01); *G10L 21/0272* (2013.01); *G10L 2019/0001* (2013.01)

(58) Field of Classification Search

None

See application file for complete search history.

(56) References Cited

U.S. PATENT DOCUMENTS

| | | | | |
|---|---|---|---|---|
| 5,023,910 | A | 6/1991 | Thomson | |
| 9,100,735 | B1 * | 8/2015 | Taenzer | H04R 3/005 |
| 9,208,794 | B1 | 12/2015 | Mascaro et al. | |
| 2008/0140396 | A1 * | 6/2008 | Grosse-Schulte | G10L 15/20 704/227 |
| 2012/0215529 | A1 | 8/2012 | Cazi et al. | |
| 2013/0282373 | A1 * | 10/2013 | Visser | G10L 21/0208 704/233 |
| 2013/0332500 | A1 * | 12/2013 | Sugiyama | G10L 21/0208 708/300 |
| 2015/0348537 | A1 * | 12/2015 | Le Roux | G10L 15/063 704/236 |
| 2016/0111108 | A1 * | 4/2016 | Erdogan | G10L 21/0216 704/202 |
| 2016/0284362 | A1 | 9/2016 | Oda | |

* cited by examiner

*Primary Examiner* — Douglas Godbold

(74) *Attorney, Agent, or Firm* — Gennadiy Vinokur; James McAleenan; Hironori Tsukamoto

(57) ABSTRACT

Systems and methods for audio signal processing including an input interface to receive a noisy audio signal including a mixture of target audio signal and noise. An encoder to map each time-frequency bin of the noisy audio signal to one or more phase-related value from one or more phase quantization codebook of phase-related values indicative of the phase of the target signal. Calculate, for each time-frequency bin of the noisy audio signal, a magnitude ratio value indicative of a ratio of a magnitude of the target audio signal to a magnitude of the noisy audio signal. A filter to cancel the noise from the noisy audio signal based on the phase-related values and the magnitude ratio values to produce an enhanced audio signal. An output interface to output the enhanced audio signal.

20 Claims, 13 Drawing Sheets

Joint quantization codebook with irregular combination

METHODS AND SYSTEMS FOR ENHANCING AUDIO SIGNALS CORRUPTED BY NOISE

FIELD

The present disclosure relates generally to audio signals, and more particularly, to audio signal processing such as source separation and speech enhancement with noise suppression methods and systems.

BACKGROUND

In conventional noise cancellation or conventional audio signal enhancement, the goal is to obtain an "enhanced audio signal" which is a processed version of a noisy audio signal that is closer in a certain sense to an underlying true "clean audio signal" or "target audio signal" of interest. In particular, in the case of speech processing, the goal of "speech enhancement" is to obtain "enhanced speech" which is a processed version of a noisy speech signal that is closer in a certain sense to the underlying true "clean speech" or "target speech".

Note that clean speech is conventionally assumed to be only available during training and not available during the real-world use of the system. For training, clean speech can be obtained with a close talking microphone, whereas the noisy speech can be obtained with a far-field microphone recorded at the same time. Or, given separate clean speech signals and noise signals, one can add the signals together to obtain noisy speech signals, where the clean and noisy pairs can be used together for training.

In conventional speech enhancement applications, speech processing is usually done using a set of features of input signals, such as short-time Fourier transform (STFT) features. The STFT obtains a complex domain spectro-temporal (or time-frequency) representation of a signal, also referred to here as a spectrogram. The STFT of the observed noisy signal can be written as the sum of the STFT of the target speech signal and the STFT of the noise signal. The STFTs of signals are complex-valued and the summation is in the complex domain. However, in conventional methods, the phase is ignored and the focus in conventional approaches has been on magnitude prediction of the "target speech" given a noisy speech signal as input. During reconstruction of the time-domain enhanced signal from its STFT, the phase of the noisy signal is typically used as the estimated phase of the enhanced speech's STFT. Using the noisy phase in combination with an estimate of the magnitude of the target speech leads in general to a reconstructed time-domain signal (i.e. obtained by inverse STFT of the complex spectrogram consisting of the product of the estimated magnitude and the noisy phase) whose magnitude spectrogram (the magnitude part of its STFT) is different from the estimate of the magnitude of the target speech that one intended to reconstruct a time-domain signal from. In this case, the complex spectrogram consisting of the product of the estimated magnitude and the noisy phase is said to be inconsistent.

Accordingly, there is need for improved speech processing methods to overcome the conventional speech enhancement applications.

SUMMARY

The present disclosure relates to providing systems and methods for audio signal processing, such as audio signal enhancement, i.e. noise suppression.

According to the present disclosure the use of the phrase "speech enhancement" is a representative example of a more general task of "audio signal enhancement", where in the case of speech enhancement the target audio signal is speech. In this present disclosure, audio signal enhancement can be referred to as the problem of obtaining an "enhanced target signal" from a "noisy signal," suppressing non-target signals. A similar task can be described as "audio signal separation", which refers to separating a "target signal" from various background signals, where the background signals can be any other non-target audio signal, or other occurrences of target signals. The present disclosure's use of the term audio signal enhancement can also encompass audio signal separation, since we can consider the combination of all background signals as a single noise signal. For example, in the case of a speech signal as the target signal, the background signals may include non-speech signals as well as other speech signals. For the purpose of this disclosure, we can consider the reconstruction of one of the speech signals as a goal, and consider the combination of all other signals as a single noise signal. Separating the target speech signal from the other signals can thus be considered as a speech enhancement task where the noise consists of all the other signals. While the use of the phrase "speech enhancement" can be an example in some embodiments, the present disclosure is not limited to speech processing, and all embodiments using speech as the target audio signal can be similarly considered as embodiments for audio signal enhancement where a target audio signal is to be estimated from a noisy audio signal. For example, references to "clean speech" can be replaced by references to "clean audio signal", "target speech" by "target audio signal", "noisy speech" by "noisy audio signal", "speech processing" by "audio signal processing", etc.

Some embodiments are based on understanding that a speech enhancement method can rely on an estimation of a time-frequency mask or time-frequency filter to be applied to a time-frequency representation of an input mixture signal, for example by multiplication of the filter and the representation, allowing an estimated signal being resynthesized using some inverse transform. Typically, however, those masks are real-valued and only modify the magnitude of the mixture signal. The values of those masks is also typically constrained to lie between zero and one. The estimated magnitude is then combined with the noisy phase. In conventional methods, this is typically justified by arguing that the minimum mean square error (MMSE) estimate of the enhanced signal's phase is the noisy signal's phase under some simplistic statistical assumptions (which typically do not hold in practice), and combining the noisy phase with an estimate of the magnitude provides acceptable results in practice.

With the advent of deep learning and the present disclosure experimentation with deep learning, the quality of the magnitude estimates obtained using deep neural networks or deep recurrent neural networks can be improved significantly compared to other methods, to a point that the noisy phase can become a limiting factor to overall performance. As an added drawback, further improving the magnitude estimate without providing phase estimation can actually decrease performance measures as learned from experimentation, such as signal to noise ratio (SNR). Indeed, if the noisy phase is incorrect, and for example, opposite to the true phase, using 0 as the estimate for the magnitude is a "better" choice than using the correct value in terms of SNR, because that correct value may point far away in the wrong direction when associated with the noisy phase, according to the present disclosure experimentation.

Learned from experimentation is that using the noisy phase is not only sub-optimal, but can also prevent further improvement of accuracy of magnitude estimation. For example, it can be detrimental for a mask estimation of magnitudes paired with the noisy phase, to estimate values larger than one, because such values can occur in regions with canceling interference between the sources, and it is likely that in those regions the estimate of the noisy phase is incorrect. For that reason, increasing the magnitude without fixing the phase is thus likely to bring the estimate further away from the reference, compared to where the original mixture was in the first place. Given a bad estimate of the phase, it is often more rewarding, in terms of an objective measure of the quality of the reconstructed signal such as the Euclidean distance between the estimated signal and the true signal, to use magnitudes smaller than the correct one, that is to "over-suppress" the noise signal in some time-frequency bins. An algorithm that is optimized under an objective function that suffers from such degradation will thus be unable to further improve the quality of its estimated magnitude with respect to the true magnitude, or in other words to output an estimated magnitude that is closer to the true magnitude under some measure of distance between magnitudes.

With that goal in mind, some embodiments are based on recognition that improvement of estimation of the target phase can not only lead to a better quality in the estimated enhanced signal thanks to the better estimation of the phase itself, but it can also allow a more faithful estimation of the enhanced magnitude with respect to the true magnitude to lead to improved quality in the estimated enhanced signal. Specifically, better phase estimation can allow more faithful estimates of the magnitudes of the target signal to actually result into improved objective measures, unlocking new heights in performance. In particular, better estimation of the target phase can allow having mask values greater than one, which could otherwise be very detrimental in situations where the phase estimate is wrong. Conventional methods typically tend to over-suppress the noise signal in such situations. But because in general the magnitude of the noisy signal can be smaller than the magnitude of the target signal, due to cancelling interference between the target signal and the noise signal in the noisy signal, it is necessary to use mask values greater than one in order to perfectly recover the magnitude of the target signal from the magnitude of the noisy signal.

Learned from experimentation is that applying phase reconstruction methods to refine the complex spectrogram obtained as the combination of an estimated magnitude spectrogram and the phase of the noisy signal can lead to improved performance. These phase reconstruction algorithms rely on iterative procedures where the phase at the previous iteration is replaced by a phase obtained from a computation involving applying to the current complex spectrogram estimate (i.e., product of the original estimated magnitude with the current phase estimate) an inverse STFT followed by an STFT, and retaining the phase only. For example, the Griffin & Lim algorithm applies such a procedure on a single signal. When multiple signal estimates that are supposed to sum up to the original noisy signal are jointly estimated, the multiple input spectrogram inversion (MISI) algorithm can be used. Further learned from experimentation is that training the network or DNN-based enhancement system to minimize an objective function including losses defined on the outcome of one or multiple steps of such iterative procedures can lead to further improvements in performance. Some embodiments are based on recognition that further performance improvements can be obtained by estimating an initial phase which improves upon the noisy phase as the initial phase used to obtain the initial complex spectrogram refined by these phase reconstruction algorithms.

Further from experimentation we learned that using mask values greater than one can be used to perfectly reconstruct the true magnitude. That's because the magnitude of the mixture may be smaller than the true magnitude, so as to multiply the magnitude by something greater than 1 in order to get back the true magnitude. However, we discovered that there can be some risk using this approach, because if the phase for that bin is wrong, then the error could be amplified.

Accordingly, there is a need to improve estimation of the phase of the noisy speech. However, phase is infamously difficult to estimate, and some embodiments aim to simplify the noise estimation problem, while still retaining acceptable potential performance.

Specifically, some embodiments are based on the recognition that a phase estimation problem can be formulated in a complex mask that can be applied to the noisy signal. Such a formulation allows estimating the phase difference between the noisy speech and the target speech, instead of the phase of the target speech itself. This is arguably an easier problem, because the phase difference is generally close to 0 in regions where the target source dominates.

More generally, some embodiments are based on recognition that the phase estimation problem may be reformulated in terms of the estimation of a phase-related quantity derived from the target signal alone, or from the target signal in combination with the noisy signal. The final estimate of the clean phase could then be obtained through further processing from a combination of this estimated phase-related quantity and the noisy signal. If the phase-related quantity is obtained through some transformation, then the further processing should aim at inverting the effects of that transformation. Several particular cases can be considered. For example, some embodiments include a first quantization codebook of phase values that can be used to estimate the phases of the target audio signal, potentially in combination with the phases of the noisy audio signal.

In regard to the first example, if the first example is a direct estimation of the clean phase, then in this case, no further processing should be required.

Another example can be the estimation of the phase in a complex mask that can be applied to the noisy signal. Such a formulation allows estimating the phase difference between the noisy speech and the target speech, instead of the phase of the target speech itself. This could be viewed as an easier problem, because the phase difference is generally close to 0 in regions where the target source dominates.

Another example is the estimation of the differential of the phase in the time direction, also known as the Instantaneous Frequency Deviation (IFD). This can also be considered in combination with the above estimation of the phase difference, for example by estimating the difference between the IFD of the noisy signal and that of the clean signal.

Another example is the estimation of the differential of the phase in the frequency direction, also known as the Group Delay. This can also be considered in combination with the above estimation of the phase difference, for example by estimating the difference between the group delay of the noisy signal and that of the clean signal.

Each of these phase-related quantities may be more reliable or effective in various conditions. For example, in relatively clean conditions, the difference from the noisy signal should be close to 0 and thus both easy to predict and a good indicator of the clean phase. In very noisy conditions and with periodic or quasi-periodic signal (e.g., voiced speech) as the target signal, the phase may be more predictable using the IFD, especially at the peaks of the target signal in the frequency domain, where the corresponding part of the signal is approximately a sine wave. We can thus also consider estimating a combination of such phase-related quantities to predict the final phase, where the weights with which to combine the estimates are determined based on the current signal and noise conditions.

In addition, some embodiments are based on recognition that it is possible to replace the problem of estimating the exact value of the phase as a continuous real number (or equivalently as a continuous real number modulo $2\pi$) by the problem of estimating a quantized value of the phase. This can be considered as the problem of selecting a quantized phase value among a finite set of quantized phase values. Indeed, in our experiments, we noticed that replacing the phase value by a quantized version often only has a small impact on the quality of the signal.

As used herein, the quantization of the phase and/or magnitude values are much coarser than the quantization of a processor performing the calculations. For example, some benefits using quantization may be that while a precision of a typical processor is quantized to floating numbers allowing the phase to have thousands of values, the quantization of the phase space used by different embodiments significantly reduces the domain of possible values of the phase. For example, in one implementation, the phase space is quantized to only two values of 0° and 180°. Such a quantization may not allow estimating a true value of the phase, but can provide a direction of the phase.

This quantized formulation of the phase estimation problem can have several benefits. Because we no longer require the algorithm to make a precise estimation, it can be easier to train the algorithm, and the algorithm can make more robust decisions within the precision level that we ask of it. Because the problem of estimating a continuous value for the phase, which is a regression problem, is replaced by that of estimating a discrete value for the phase from a small set of values, which is a classification problem, we can make use of the strength of classification algorithms such as neural networks to perform the estimation. Even though it may be impossible for the algorithm to estimate the exact value of a particular phase, because it can now only choose among a finite set of discrete values, the final estimation may be better because the algorithm can make a more accurate selection. For example, if we imagine that the error in some regression algorithm that estimates a continuous value is 20%, while another classification algorithm that selects the closest discrete phase value never makes a mistake, if any continuous value for the phase is within 10% of one of the discrete phase values, then the error of the classification algorithm will be at most 10%, lower than that of the regression algorithm. The above numbers are hypothetical and only mentioned here as an illustration.

There are multiple difficulties with regression-based methods to estimate phase, depending on how we parametrize phase.

If we parametrize phase as a complex number, then we encounter a convexity problem. Regression computes an expected mean, or in other words a convex combination, as its estimate. However, for a given magnitude, any expected value over signals with that magnitude but different phases will in general result in a signal with a different magnitude, due to the phase cancellation. Indeed, the average of two unit-length vectors with different directions has magnitude less than one.

If we parametrize phase as an angle, then we encounter a wraparound problem. Because angles are defined modulo $2\pi$, there is no consistent way to define an expected value, other than via the complex-number parametrization of phase, which suffers from the problems described above.

On the other hand, a classification-based approach to phase estimation estimates a distribution of phases, from which one can sample, and avoids considering expectations as the estimate. Thus, the estimate that we can recover avoids the phase cancellation problem. Furthermore, using discrete representations for the phase makes it easy to introduce conditional relationships between estimates at different times and frequencies, for example using a simple probabilistic chain rule. This last point is also an argument in favor of using discrete representations for estimating the magnitudes.

For example, one embodiment includes an encoder to map each time-frequency bin of the noisy speech to a phase value from a first quantization codebook of phase values indicative of quantized phase differences between phases of the noisy speech and phases of the target speech or clean speech. The first quantization codebook quantizes the phase space of differences between phases of the noisy speech and phases of the target speech to reduce the mapping to the classification task. For example, in some implementations, the first quantization codebook of predetermined phase values is stored in a memory operatively connected to a processor of the encoder allowing the encoder to determine only an index of the phase value in the first quantization codebook. At least one aspect can include the first quantization codebook to be used for training the encoder, e.g., implemented using a neural network to map a time-frequency bin of the noisy speech only to the values from the first quantization codebook.

In some embodiments, the encoder can also determine, for each time-frequency bin of the noisy speech, a magnitude ratio value indicative of a ratio of a magnitude of the target speech (or clean speech) to a magnitude of the noisy speech. The encoder can use different methods for determining the magnitude ratio values. However, in one embodiment, the encoder also maps each time-frequency bin of the noisy speech to the magnitude ratio value from a second quantization codebook. This particular embodiment unifies approaches for determining both the phase values and magnitude values, which allows the second quantization codebook to include multiple magnitude ratio values including at least one magnitude ratio value greater than one. In such a manner, the magnitude estimation can be further enhanced.

For example, in one implementation, the first quantization codebook and the second quantization codebook form a joint codebook with combinations of the phase values and the magnitude ratio values, such that the encoder maps each time-frequency bin of the noisy speech to the phase value and the magnitude ratio value forming a combination in the joint codebook. This embodiment allows to jointly determine quantized phase and magnitude ratio values to optimize the classification. For example, the combinations of the phase values and the magnitude ratio values can be determined off-line to minimize an estimation error between training enhanced speech and corresponding training target speech.

The optimization allows determining the combinations of the phase and magnitude ratio values in a different manner. For example, in one embodiment, the phase values and the magnitude ratio values are combined regularly and fully such that each phase value in the joint codebook forms a combination with each magnitude ratio value in the joint codebook. This embodiment is easier to implement, and also such a regular joint codebook can be naturally used for training the encoder.

Another embodiment can include the phase values and the magnitude ratio values to be combined irregularly, such that the joint codebook includes magnitude ratio values forming combinations with different sets of phase values. This specific embodiment allows increasing the quantization to simplify the computation.

In some embodiments, the encoder uses a neural network to determine the phase value in quantized space of the phase values and/or the magnitude ratio value in quantized space of the magnitude ratio values. For example, in one embodiment, the speech processing system includes a memory to store the first quantization codebook and the second quantization codebook, and to store a neural network trained to process the noisy speech to produce a first index of the phase value in the first quantization codebook and a second index of the magnitude ratio value in the second quantization codebook. In such a manner, the encoder can be configured to determine the first index and the second index using the neural network, to retrieve the phase value from the memory using the first index, and to retrieve the magnitude ratio value from the memory using the second index.

To take advantage of the phase and magnitude ratio estimation, some embodiments include a filter to cancel the noise from the noisy speech based on the phase values and the magnitude ratio values to produce an enhanced speech and an output interface to output the enhanced speech. For example, one embodiment updates time-frequency coefficients of the filter using the phase value and the magnitude ratio value determined by the encoder for each time-frequency bin, and multiplies the time-frequency coefficients of the filter with a time-frequency representation of the noisy speech to produce a time-frequency representation of the enhanced speech.

For example, one embodiment can use deep neural networks to estimate a time-frequency filter to be multiplied with the time-frequency representation of the noisy speech in order to obtain a time-frequency representation of an enhanced speech. The network performs the estimation of the filter by determining, at each time-frequency bin, a score for each element of a filter codebook, and these scores are in turn used to construct an estimate of the filter at that time-frequency bin. Through experimenting we discovered that such a filter can be effectively estimated using deep neural networks (DNN), including deep recurrent neural networks (DRNN).

In another embodiment, the filter is estimated in terms of its magnitude and phase components. The network performs the estimation of the magnitude (resp. phase) by determining, at each time-frequency bin, a score for each element of a magnitude (resp. phase) codebook, and these scores are in turn used to construct an estimate of the magnitude (resp. phase).

In another embodiment, parameters of the network are optimized so as to minimize a measure of reconstruction quality of the estimated complex spectrogram with respect to the reference complex spectrogram of the clean target signal. The estimated complex spectrogram can be obtained by combining the estimated magnitude and the estimated phase, or it can be obtained by further refining via a phase reconstruction algorithm.

In another embodiment, parameters of the network are optimized so as to minimize a measure of reconstruction quality of the reconstructed time-domain signal with respect to the clean target signal in the time domain. The reconstructed time-domain signal can be obtained as the direct reconstruction of the estimated complex spectrogram itself obtained by combining the estimated magnitude and the estimated phase, or it can be obtained via a phase reconstruction algorithm. The cost function measuring reconstruction quality on the time-domain signals can be defined as a measure of goodness of fit in the time domain, for example as the Euclidean distance between the signals. The cost function measuring reconstruction quality on the time-domain signals can also be defined as a measure of goodness of fit between the respective time-frequency representations of the time-domain signals. For example, a potential measure in this case is the Euclidean distance between the respective magnitude spectrograms of the time-domain signals.

According to an embodiment of the present disclosure, a system for audio signal processing system including an input interface to receive a noisy audio signal including a mixture of a target audio signal and noise. An encoder to map each time-frequency bin of the noisy audio signal to one or more phase-related values from one or more phase quantization codebooks of phase-related values indicative of the phase of the target signal. The encoder to calculate, for each time-frequency bin of the noisy audio signal, a magnitude ratio value indicative of a ratio of a magnitude of the target audio signal to a magnitude of the noisy audio signal. A filter to cancel the noise from the noisy audio signal based on the one or more phase-related values and the magnitude ratio values to produce an enhanced audio signal. An output interface to output the enhanced audio signal.

According to another embodiment of the present disclosure, a method for audio signal processing having a hardware processor coupled with a memory, wherein the memory has stored instructions and other data, and when executed by the hardware processor carry out some steps of the method. The method including accepting by an input interface, a noisy audio signal including a mixture of target audio signal and noise. Mapping by the hardware processor, each time-frequency bin of the noisy audio signal to one or more phase-related values from one or more phase quantization codebook of phase-related values indicative of the phase of the target signal. Calculating by the hardware processor, for each time-frequency bin of the noisy audio signal, a magnitude ratio value indicative of a ratio of a magnitude of the target audio signal to a magnitude of the noisy audio signal. Cancelling using a filter, the noise from the noisy audio signal based on the phase values and the magnitude ratio values to produce an enhanced audio signal. Outputting by an output interface, the enhanced audio signal.

According to another embodiment of the present disclosure, a non-transitory computer readable storage medium embodied thereon a program executable by a hardware processor for performing a method. The method including accepting a noisy audio signal including a mixture of target audio signal and noise. Mapping each time-frequency bin of the noisy audio signal to a phase value from a first quantization codebook of phase values indicative of quantized phase differences between phases of the noisy audio signal and phases of the target audio signal. Mapping by the hardware processor, each time-frequency bin of the noisy audio signal to one or more phase-related values from one or more phase quantization codebook of phase-related values indicative of the phase of the target signal. Calculating by the hardware processor, for each time-frequency bin of the noisy audio signal, a magnitude ratio value indicative of a ratio of a magnitude of the target audio signal to a magnitude of the noisy audio signal. Cancelling using a filter, the noise from the noisy audio signal based on the phase values and the magnitude ratio values to produce an enhanced audio signal. Outputting by an output interface, the enhanced audio signal.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

Overview

The present disclosure relates to providing systems and methods for speech processing, including speech enhancement with noise suppression.

Some embodiments of the present disclosure include an audio signal processing system having an input interface to receive a noisy audio signal including a mixture of target audio signal and noise. An encoder to map each time-frequency bin of the noisy audio signal to one or more phase-related value from one or more phase quantization codebook of phase-related values indicative of the phase of the target signal. Calculate, for each time-frequency bin of the noisy audio signal, a magnitude ratio value indicative of a ratio of a magnitude of the target audio signal to a magnitude of the noisy audio signal. A filter to cancel the noise from the noisy audio signal based on the phase-related values and the magnitude ratio values to produce an enhanced audio signal. An output interface to output the enhanced audio signal.

Figure 1A:
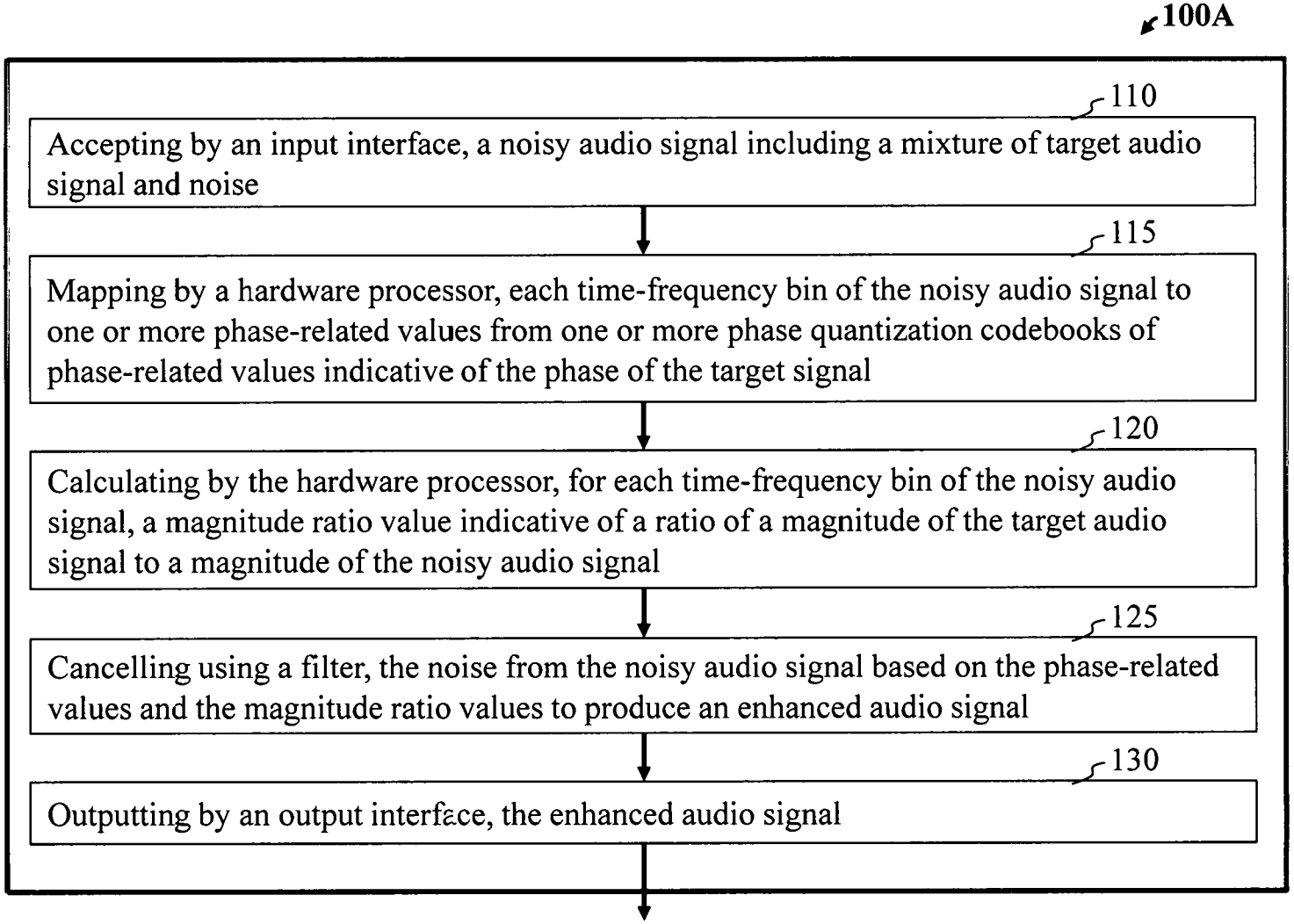
FIG. 1A is a flow diagram illustrating a method for audio signal processing, according to embodiments of the present disclosure.
Figure 1B:
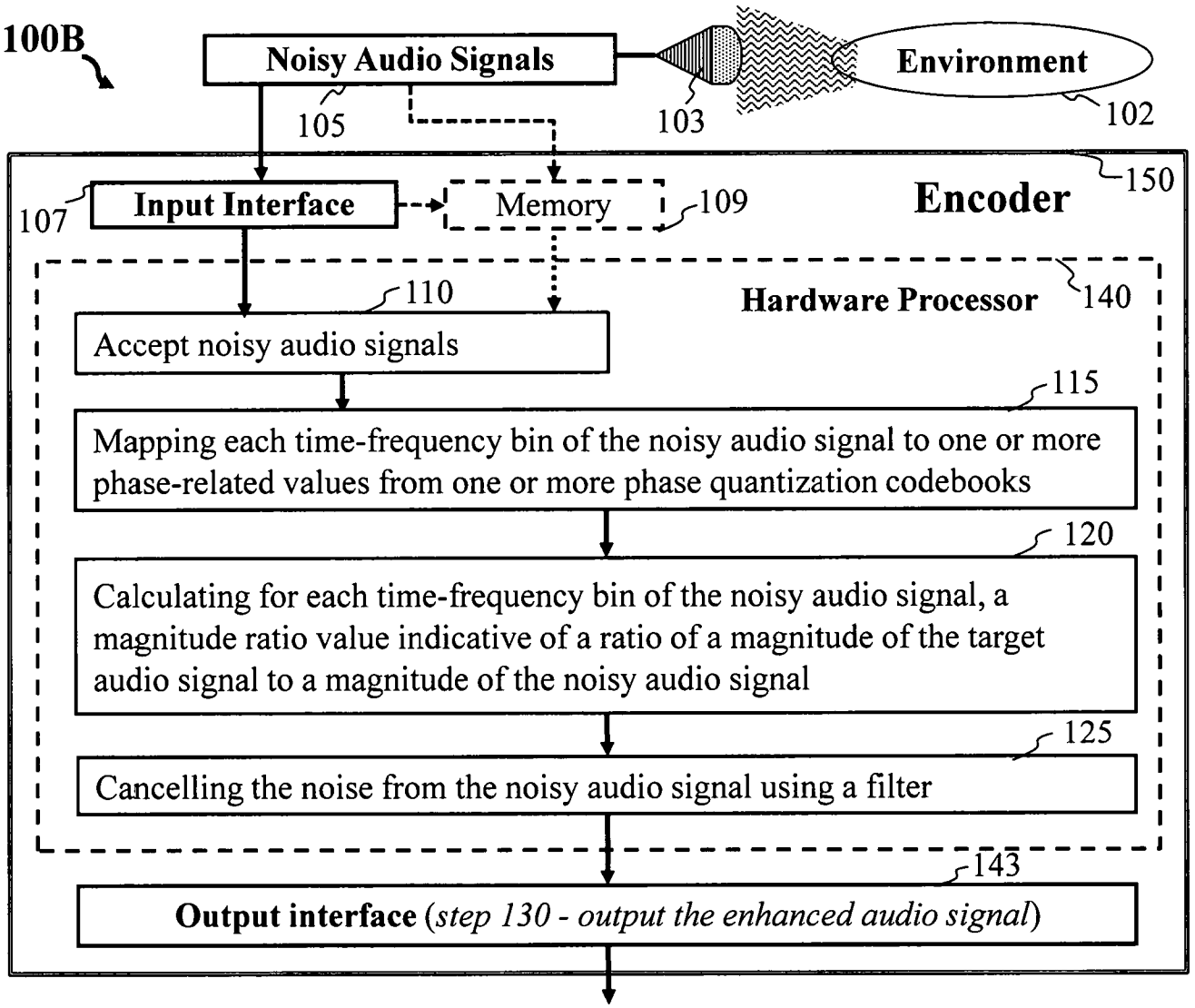
FIG. 1B is a block diagram illustrating a method for audio signal processing, implemented using some components of the system, according to embodiments of the present disclosure.

Referring to FIG. 1A and FIG. 1B, FIG. 1A is a flow diagram illustrating an audio signal processing method. The method 100A can use a hardware processor coupled with a memory. Such that the memory can have stored instructions and other data, and when executed by the hardware processor carry out some steps of the method. Step 110 includes accepting a noisy audio signal having a mixture of target audio signal and noise via an input interface.

Step 115 of FIG. 1A and FIG. 1B, includes mapping via the hardware processor, such that each time-frequency bin of the noisy audio signal to one or more phase-related values from one or more phase quantization codebooks of phase-related values is indicative of the phase of the target signal. The one or more phase quantization codebooks can be stored in memory 109 or can be accessed through a network. The one or more phase quantization codebooks can contain values that have been set manually beforehand or may be obtained by an optimization procedure to optimize performance, for example via training on a dataset of training data. The values contained in the one or more phase quantization codebooks are indicative of the phase of the enhanced speech, by themselves or in combination with the noisy audio signal. The system chooses the most relevant value or combination of values within the one or more phase quantization codebooks for each time-frequency bin, and this value or combination of values is used to estimate a phase of the enhanced audio signal at each time-frequency bin. For example, if the phase-related values are representative of the difference between the phase of the noisy audio signal and the phase of the clean target signal, an example of phase quantization codebook may contain several values such as $$-\frac{\pi}{2}, 0, \frac{\pi}{2}, \pi,$$

and the system may select the value 0 for bins whose energy is strongly dominated by the target signal energy: selecting the value 0 for such bins results in using the phase of the noisy signal as is for these bins, as the phase component of the filter at those bins will be equal to $e^{0*i}=1$, where i denotes the imaginary unit of complex numbers, which will leave the phase of the noisy signal unchanged.

Step 120 of FIG. 1A and FIG. 1B, calculating by the hardware processor, for each time-frequency bin of the noisy audio signal, a magnitude ratio value indicative of a ratio of a magnitude of the target audio signal to a magnitude of the noisy audio signal. For example, an enhancement network may estimate a magnitude ratio value close to 0 for those bins where the energy of the noisy signal is dominated by that of the noise signal, and it may estimate a magnitude ratio value close to 1 for those bins where the energy of the noisy signal is dominated by that of the target signal. It may estimate a magnitude ratio value larger than 1 for those bins where the interaction of the target signal and the noise signal resulted in a noisy signal whose energy is smaller than that of the target signal.

Step 125 of FIG. 1A and FIG. 1B, can include cancelling using a filter, the noise from the noisy audio signal based on the phase values and the magnitude ratio values to produce an enhanced audio signal. The time-frequency filter is for example obtained at each time-frequency bin by multiplying the calculated magnitude ratio value at that bin with the estimate of the phase difference between the noisy signal and the target signal obtained using the mapping of that time-frequency bin to the one or more phase-related values from the one or more phase quantization codebooks. For example, if the calculated magnitude ratio value at bin (t,f) for time frame t and frequency f is $m_{t,f}$ and the angular value of the estimate of the phase difference between the noisy signal and the target signal at that bin is $\varphi_{t,f}$, then a value of a filter at that bin can be obtained as $m_{t,f}e^{i\varphi_{t,f}}$. This filter can then be multiplied with a time-frequency representation of the noisy signal to obtain a time-frequency representation of an enhanced audio signal. For example, this time-frequency representation can be a short-time Fourier transform, in which case the obtained time-frequency representation of an enhanced audio signal can be processed by inverse short-time Fourier transform to obtain a time-domain enhanced audio signal. Alternatively, the obtained time-frequency representation of an enhanced audio signal can be processed by a phase reconstruction algorithm to obtain a time-domain enhanced audio signal.

The speech enhancement method 100 is directed to, among other things, obtain "enhanced speech" which is a processed version of the noisy speech that is closer in a certain sense to the underlying true "clean speech" or "target speech".

Note that target speech, i.e. clean speech, can be assumed to be only available during training, and not available during the real-world use of the system, according to some embodiments. For training, clean speech can be obtained with a close talking microphone, whereas the noisy speech can be obtained with a far-field microphone recorded at the same time, according to some embodiments. Or, given separate clean speech signals and noise signals, one can add the signals together to obtain noisy speech signals, where the clean and noisy pairs can be used together for training.

Step 130 of FIG. 1A and FIG. 1B, can include outputting by an output interface, the enhanced audio signal.

Embodiments of the present disclosure provide unique aspects, by non-limiting example, an estimate of the phase of the target signal is obtained by relying on the selection or combination of a limited number of values within one or more phase quantization codebooks. These aspects allow the present disclosure to obtain a better estimate of the phase of the target signal, resulting in a better quality for the enhanced target signal.

Referring to FIG. 1B, FIG. 1B is a block diagram illustrating a method for speech processing, implemented using some components of the system, according to embodiments of the present disclosure. For example, FIG. 1B can be a block diagram illustrating the system of FIG. 1A, by non-limiting example, wherein the system 100B is implemented using some components, including a hardware processor 140 in communication with an input interface 142, occupant transceiver 144, a memory 146, a transmitter 148, a controller 150. The controller can be connected to the set of devices 152. The occupant transceiver 144 can be a wearable electronic device that the occupant (user) wears to control the set of devices 152 as well as can send and receive information.

It is contemplated the hardware processor 140 can include two or more hardware processors depending upon the requirements of the specific application. Certainly, other components may be incorporated with method 100 including input interfaces, output interfaces and transceivers.

Figure 1C:
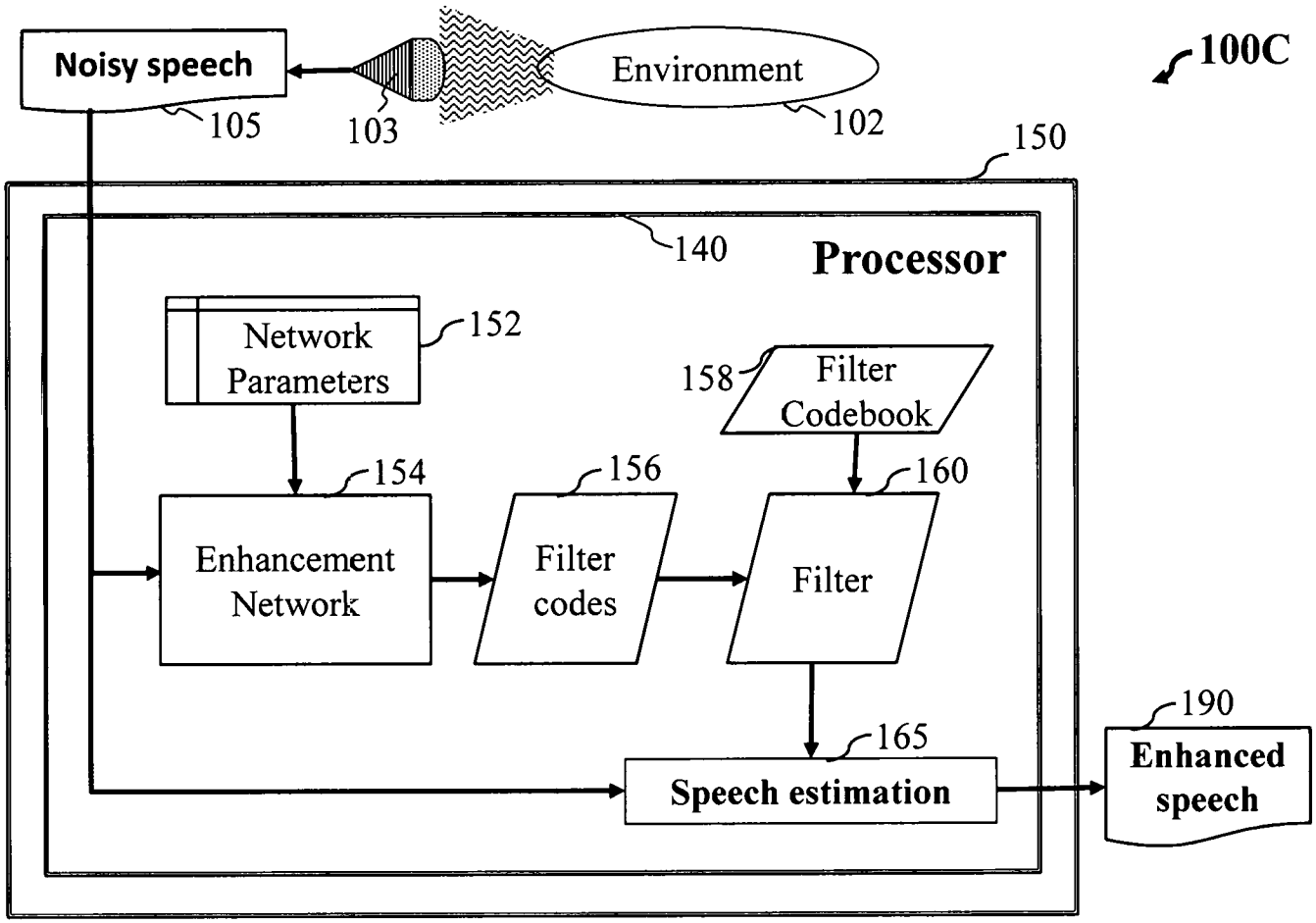
FIG. 1C is a flow diagram illustrating noise suppression from a noisy speech signal using deep recurrent neural networks, where a time-frequency filter is estimated at each time-frequency bin using the output of the neural network and a codebook of filter prototypes, this time-frequency filter is multiplied with a time-frequency representation of the noisy speech to obtain a time-frequency representation of an enhanced speech, and this time-frequency representation of an enhanced speech is used to reconstruct an enhanced speech, according to embodiments of the present disclosure.

FIG. 1C is a flow diagram illustrating noise suppression using deep neural networks, where a time-frequency filter is estimated at each time-frequency bin using the output of the neural network and a codebook of filter prototypes, and this time-frequency filter is multiplied with a time-frequency representation of the noisy speech to obtain a time-frequency representation of an enhanced speech, according to embodiments of the present disclosure. The system illustrates using as example a case of speech enhancement, that is the separation of speech from noise within a noisy signal, but the same considerations apply to more general cases such as source separation, in which the system estimates multiple target audio signals from a mixture of target audio signals and potentially other non-target sources such as noise. For example, FIG. 1C illustrates an audio signal processing system 100C for estimating using processor 140 a target speech signal 190 from an input noisy speech signal 105 obtained from a sensor 103 such as a microphone monitoring an environment 102. The system 100C processes the noisy speech 105 using an enhancement network 154 with network parameters 152. The enhancement network 154 maps each time-frequency bin of a time-frequency representation of the noisy speech 105 to one or more filter codes 156 for that time-frequency bin. For each time-frequency bin, the one or more filter codes 156 are used to select or combine values corresponding to the one or more filter codes within a filter codebook 158 to obtain a filter 160 for that time-frequency bin. For example, if the filter codebook 158 contains five values $v_0=-1$, $v_1=0$, $v_2=1$, $v_3=-i$, $v_4=i$, the enhancement network 154 may estimate a code $c_{t,f}\in\{0,1,2,3,4\}$ for a time-frequency bin t,f, in which case the value of the filter 160 at time-frequency bin t,f may be set to $w_{t,f}=v_{c_{t,f}}$. A speech estimation module 165 then multiplies the time-frequency representation of the noisy speech 105 with the filter 160 to obtain a time-frequency representation of the enhanced speech, and inverts that time-frequency representation of the enhanced speech to obtain the enhanced speech signal 190.

Figure 1D:
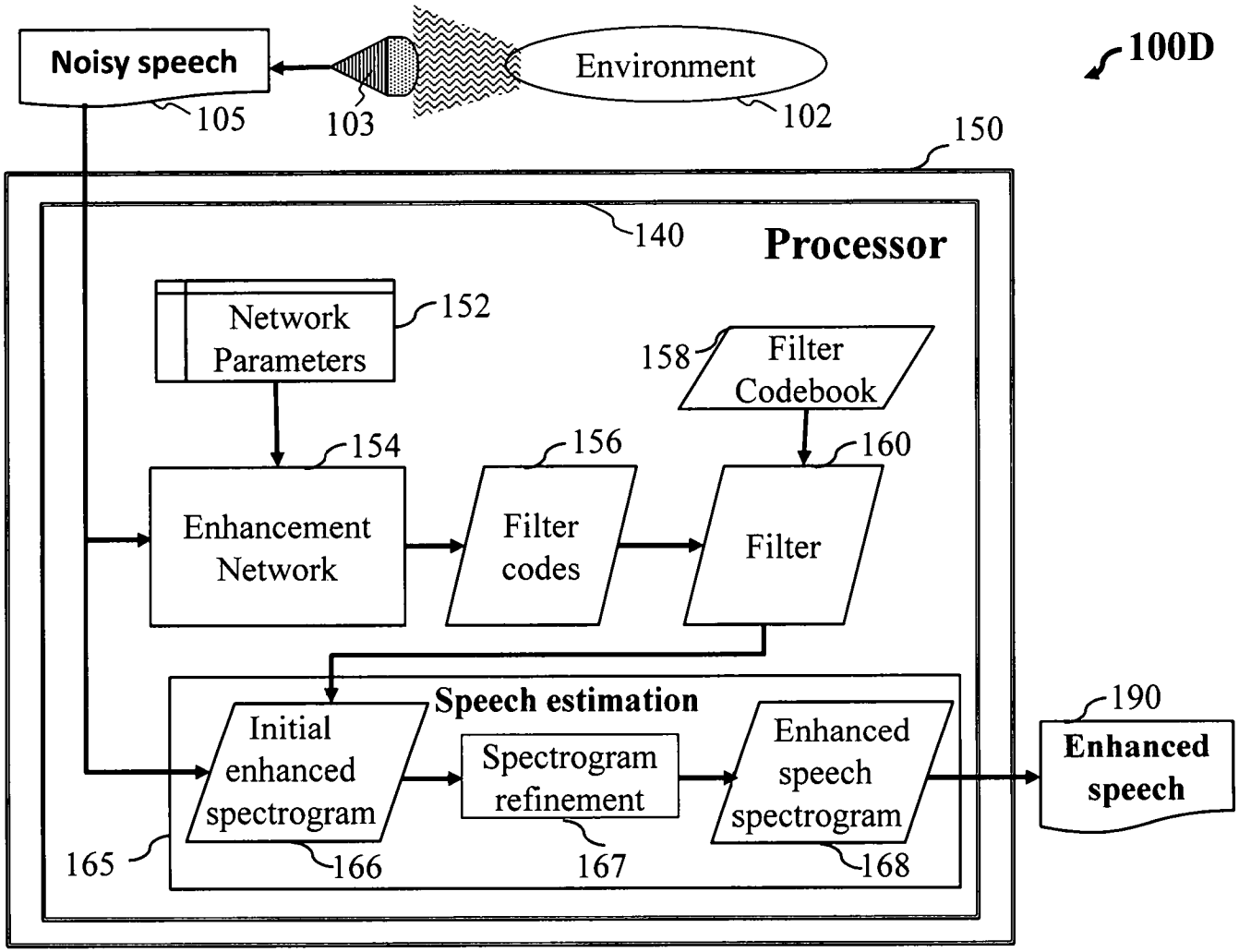
FIG. 1D is a flow diagram illustrating noise suppression using deep recurrent neural networks, where a time-frequency filter is estimated at each time-frequency bin using the output of the neural network and a codebook of filter prototypes, this time-frequency filter is multiplied with a time-frequency representation of the noisy speech to obtain an initial time-frequency representation of an enhanced speech ("initial enhanced spectrogram" in FIG. 1D), and this initial time-frequency representation of an enhanced speech is used to reconstruct an enhanced speech via a spectrogram refinement module as follows: the initial time-frequency representation of an enhanced speech is refined using a spectrogram refinement module for example based on a phase reconstruction algorithm to obtain a time-frequency representation of an enhanced speech ("enhanced speech spectrogram" in FIG. 1D), and this time-frequency representation of an enhanced speech is used to reconstruct an enhanced speech, according to embodiments of the present disclosure.

FIG. 1D is a flow diagram illustrating noise suppression using deep neural networks, where a time-frequency filter is estimated at each time-frequency bin using the output of the neural network and a codebook of filter prototypes, this time-frequency filter is multiplied with a time-frequency representation of the noisy speech to obtain an initial time-frequency representation of an enhanced speech ("initial enhanced spectrogram" in FIG. 1D), and this initial time-frequency representation of an enhanced speech is used to reconstruct an enhanced speech via a spectrogram refinement module as follows: the initial time-frequency representation of an enhanced speech is refined using a spectrogram refinement module for example based on a phase reconstruction algorithm to obtain a time-frequency representation of an enhanced speech ("enhanced speech spectrogram" in FIG. 1D), and this time-frequency representation of an enhanced speech is used to reconstruct an enhanced speech, according to embodiments of the present disclosure.

For example, FIG. 1D illustrates an audio signal processing system 100D for estimating using processor 140 a target speech signal 190 from an input noisy speech signal 105 obtained from a sensor 103 such as a microphone monitoring an environment 102. The system 100D processes the noisy speech 105 using an enhancement network 154 with network parameters 152. The enhancement network 154 maps each time-frequency bin of a time-frequency representation of the noisy speech 105 to one or more filter codes 156 for that time-frequency bin. For each time-frequency bin, the one or more filter codes 156 are used to select or combine values corresponding to the one or more filter codes within a filter codebook 158 to obtain a filter 160 for that time-frequency bin. For example, if the filter codebook 158 contains five values $v_0=-1$, $v_1=0$, $v_2=1$, $v_3=-i$, $v_4=i$, the enhancement network 154 may estimate a code $c_{t,f}\in\{0,1,2,3,4\}$ for a time-frequency bin t,f, in which case the value of the filter 160 at time-frequency bin t,f may be set to $w_{t,f}=v_{c_{t,f}}$. A speech estimation module 165 then multiplies the time-frequency representation of the noisy speech 105 with the filter 160 to obtain an initial time-frequency representation of the enhanced speech, here denoted as initial enhanced spectrogram 166, processes this initial enhanced spectrogram 166 using a spectrogram refinement module 167, for example based on a phase reconstruction algorithm, to obtain time-frequency representation of the enhanced speech here denoted as enhanced speech spectrogram 168, and inverts that enhanced speech spectrogram 168 to obtain the enhanced speech signal 190.

Figure 2:
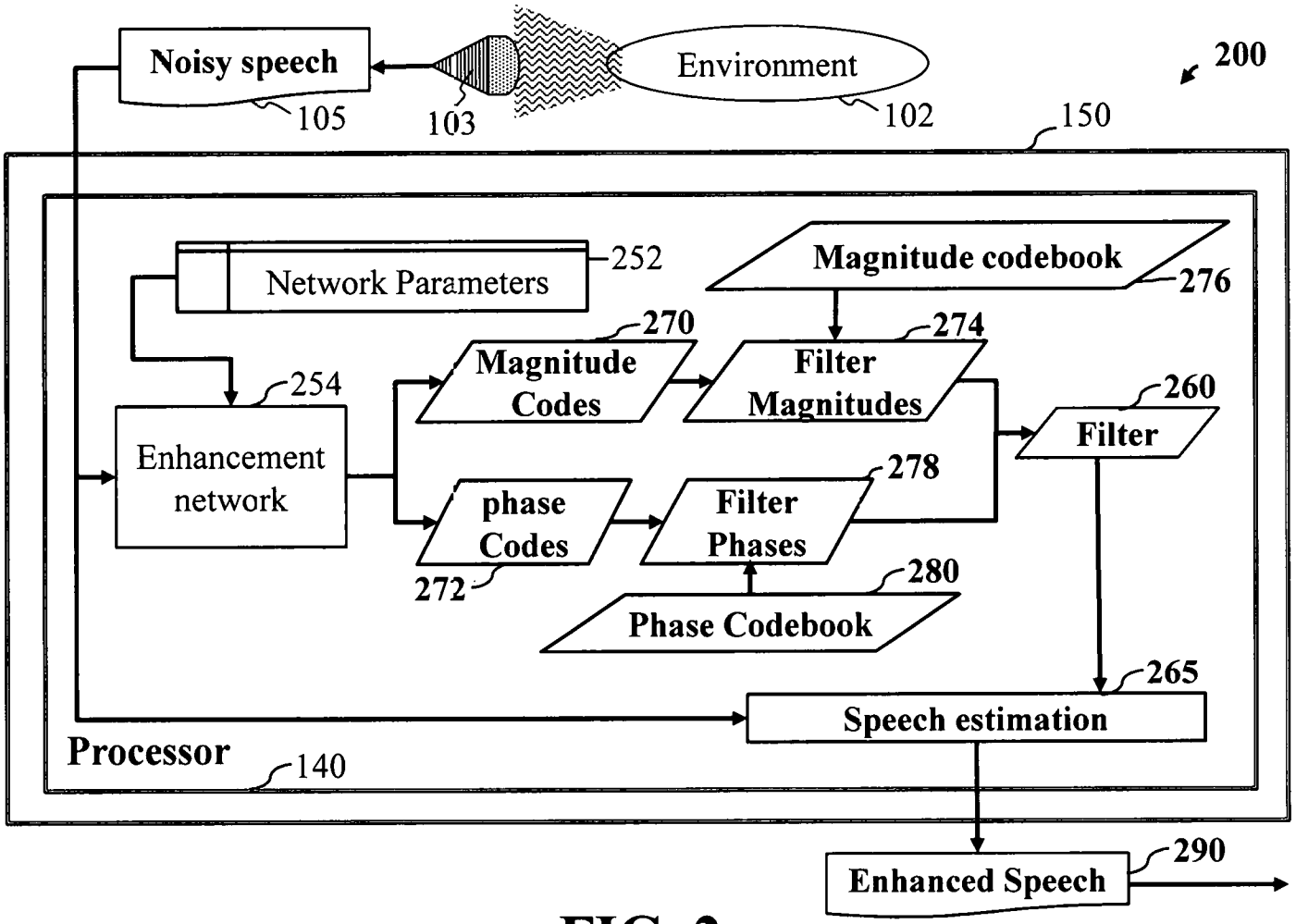
FIG. 2 is another flow diagram illustrating noise suppression using deep recurrent neural networks, where a time-frequency filter is estimated as a product of a magnitude and a phase components, where each component is estimated at each time-frequency bin using the output of the neural network and a corresponding codebook of prototypes, this time-frequency filter is multiplied with a time-frequency representation of the noisy speech to obtain a time-frequency representation of an enhanced speech, and this time-frequency representation of an enhanced speech is used to reconstruct an enhanced speech, according to embodiments of the present disclosure.

FIG. 2 is another flow diagram illustrating noise suppression using deep neural networks, where a time-frequency filter is estimated as a product of a magnitude and a phase components, where each component is estimated at each time-frequency bin using the output of the neural network and a corresponding codebook of prototypes, and this time-frequency filter is multiplied with a time-frequency representation of the noisy speech to obtain a time-frequency representation of an enhanced speech, according to embodiments of the present disclosure. For example, the method 200 of FIG. 2 estimates using processor 140 a target speech signal 290 from an input noisy speech signal 105 obtained from a sensor 103 such as a microphone monitoring an environment 102. The system 200 processes the noisy speech 105 using an enhancement network 254 with network parameters 252. The enhancement network 254 maps each time-frequency bin of a time-frequency representation of the noisy speech 105 to one or more magnitude codes 270 and one or more phase codes 272 for that time-frequency bin. For each time-frequency bin, the one or more magnitude codes 270 are used to select or combine magnitude values corresponding to the one or more magnitude codes within a magnitude codebook 158 to obtain a filter magnitude 274 for that time-frequency bin. For example, if the magnitude codebook 276 contains four values $v_0^{(m)}=0$, $v_1^{(m)}=0.5$, $v_2^{(m)}=1$, $v_3^{(m)}=2$, the enhancement network 254 may estimate a code $c_{t,f}^{(m)}\in\{0,1,2,3\}$ for a time-frequency bin t,f, in which case the value of the filter magnitude 274 at time-frequency bin t,f may be set to $$w_{t,f}^{(m)} = v_{c_{t,f}^{(m)}}^{(m)}.$$

For each time-frequency bin, the one or more phase codes 272 are used to select or combine phase-related values corresponding to the one or more phase codes within a phase codebook 280 to obtain a filter phase 278 for that time-frequency bin. For example, if the phase codebook 280 contains four values $$v_0^{(p)} = -\frac{\pi}{2},\ v_1^{(p)} = 0,\ v_2^{(p)} = \frac{\pi}{2},\ v_3^{(p)} = \pi,$$

the enhancement network 254 may estimate a code $c_{t,f}^{(p)}\in\{0,1,2,3\}$ for a time-frequency bin t,f, in which case the value of the filter phase 278 at time-frequency bin t,f may be set to $$w_{t,f}^{(p)} = e^{iv_{c_{t,f}^{(p)}}^{(p)}}.$$

The filter magnitudes 274 and filter phases 278 are combined to obtain a filter 260. For example they can be combined by multiplying their values at each time-frequency bin t,f, in which case the value of the filter 260 at time-frequency bin t,f may be set to $$w_{t,f} = w_{t,f}^{(m)} w_{t,f}^{(p)} = v_{c_{t,f}^{(m)}}^{(m)} e^{iv_{c_{t,f}^{(p)}}^{(p)}}.$$

A speech estimation module 265 then multiplies at each time-frequency bin the time-frequency representation of the noisy speech 105 with the filter 260 to obtain a time-frequency representation of the enhanced speech, and inverts that time-frequency representation of the enhanced speech to obtain the enhanced speech signal 290.

Figure 3:
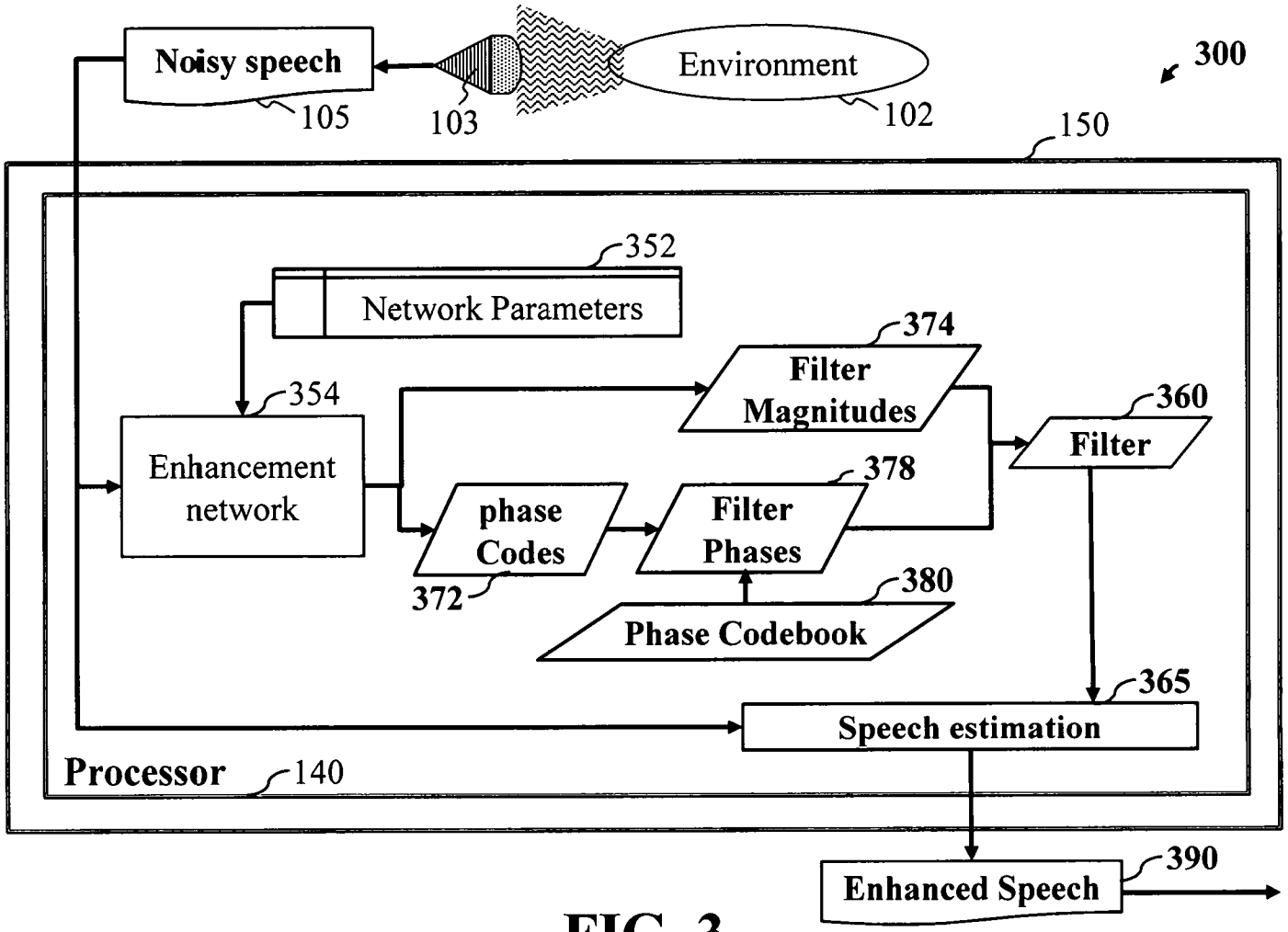
FIG. 3 is a flow diagram of an embodiment where only the phase component of the filter is estimated using a codebook, according to embodiments of the present disclosure.

FIG. 3 is a flow diagram of an embodiment where only the phase component of the filter is estimated using a codebook, according to embodiments of the present disclosure. For example, the method 300 of FIG. 3 estimates using processor 140 a target speech signal 390 from an input noisy speech signal 105 obtained from a sensor 103 such as a microphone monitoring an environment 102. The method 300 processes the noisy speech 105 using an enhancement network 354 with network parameters 352. The enhancement network 354 estimates a filter magnitude 374 for each time-frequency bin of a time-frequency representation of the noisy speech 105, and the enhancement network 354 also maps each time-frequency bins to one or more phase codes 372 for that time-frequency bin. For each time-frequency bin, a filter magnitude 374 is estimated by the network as indicative of the ratio of magnitude of the target speech with respect to the noisy speech for that time-frequency bin. For example, the enhancement network 354 may estimate a filter magnitude $w_{t,f}^{(m)}$ for a time-frequency bin t,f such that $w_{t,f}^{(m)}$ is a non-negative real number, whose range may be unlimited or it may be limited to a specific range such as [0,1] or [0,2]. For each time-frequency bin, the one or more phase codes 372 are used to select or combine phase-related values corresponding to the one or more phase codes within a phase codebook 380 to obtain a filter phase 378 for that time-frequency bin. For example, if the phase codebook 380 contains four values $$v_0^{(p)} = -\frac{\pi}{2},\ v_1^{(p)} = 0,\ v_2^{(p)} = \frac{\pi}{2},\ v_3^{(p)} = \pi,$$

the enhancement network 354 may estimate a code $c_{t,f}^{(p)} \in \{0,1,2,3\}$ for a time-frequency bin t,f, in which case the value of the filter phase 378 at time-frequency bin t,f may be set to $$w_{t,f}^{(p)} = e^{iv_{c_{t,f}^{(p)}}^{(p)}}.$$

The filter magnitudes 374 and filter phases 378 are combined to obtain a filter 360. For example they can be combined by multiplying their values at each time-frequency bin t,f, in which case the value of the filter 360 at time-frequency bin t,f may be set to $$w_{t,f} = w_{t,f}^{(m)} w_{t,f}^{(p)} = w_{t,f}^{(m)} e^{iv_{c_{t,f}^{(p)}}^{(p)}}.$$

A speech estimation module 365 then multiplies at each time-frequency bin the time-frequency representation of the noisy speech 105 with the filter 360 to obtain a time-frequency representation of the enhanced speech, and inverts that time-frequency representation of the enhanced speech to obtain the enhanced speech signal 390.

Figure 4:
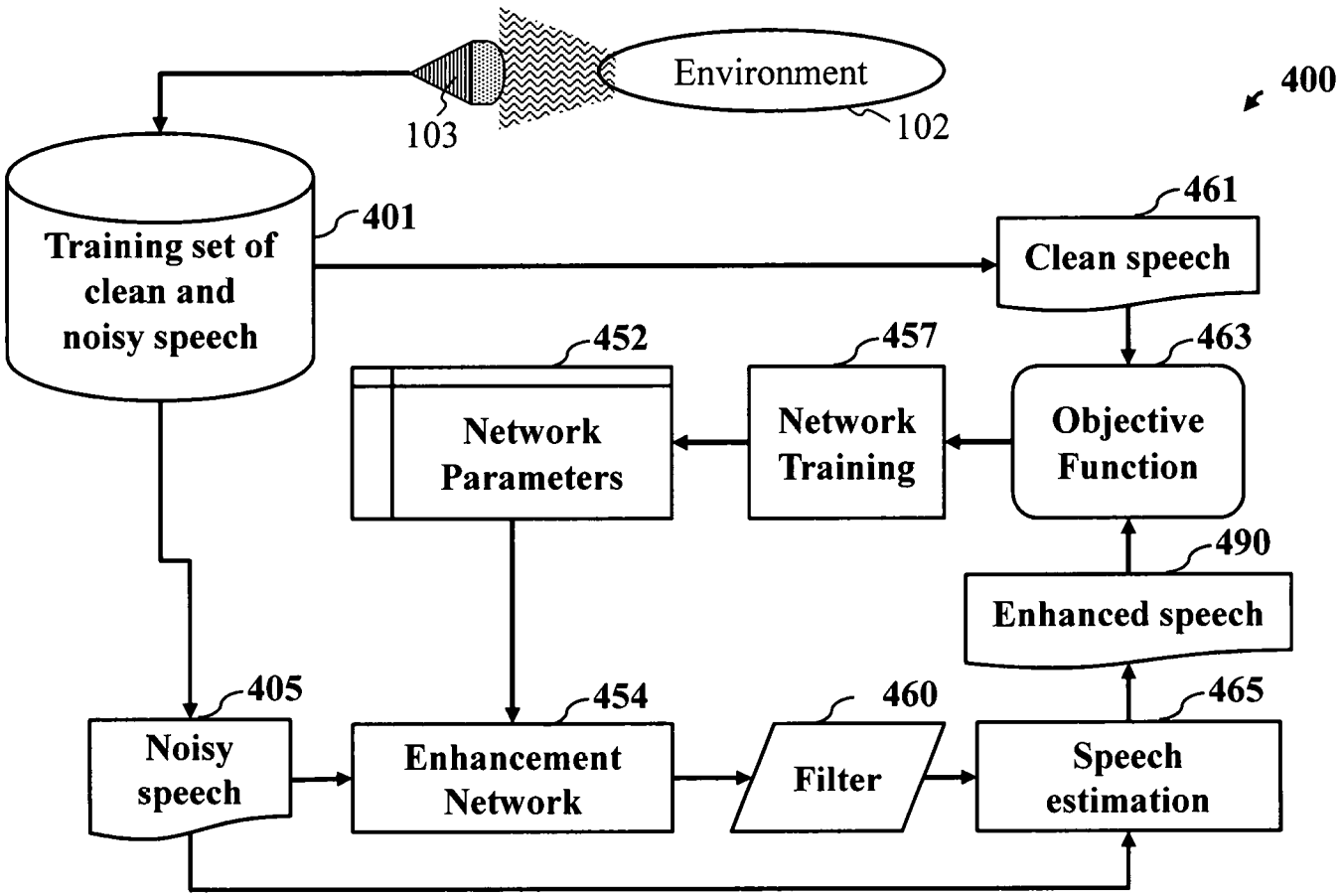
FIG. 4 is a flow diagram of the training stage of the algorithm, according to embodiments of the present disclosure.

FIG. 4 is a flow diagram illustrating training of an audio signal processing system 400 for speech enhancement, according to embodiments of the present disclosure. The system illustrates using as example a case of speech enhancement, that is the separation of speech from noise within a noisy signal, but the same considerations apply to more general cases such as source separation, in which the system estimates multiple target audio signals from a mixture of target audio signals and potentially other non-target sources such as noise. A noisy input speech signal 405 including a mixture of speech and noise and the corresponding clean signals 461 for the speech and noise are sampled from the training set of clean and noisy audio 401. The noisy input signal 405 is processed by an enhancement network 454 to compute a filter 460 for the target signal, using stored network parameters 452. A speech estimation module 465 then multiplies at each time-frequency bin the time-frequency representation of the noisy speech 405 with the filter 460 to obtain a time-frequency representation of the enhanced speech, and inverts that time-frequency representation of the enhanced speech to obtain the enhanced speech signal 490. An objective function computation module 463 computes an objective function by computing a distance between the clean speech and the enhanced speech. The objective function can be used by a network training module 457 to update the network parameters 452.

Figure 5:
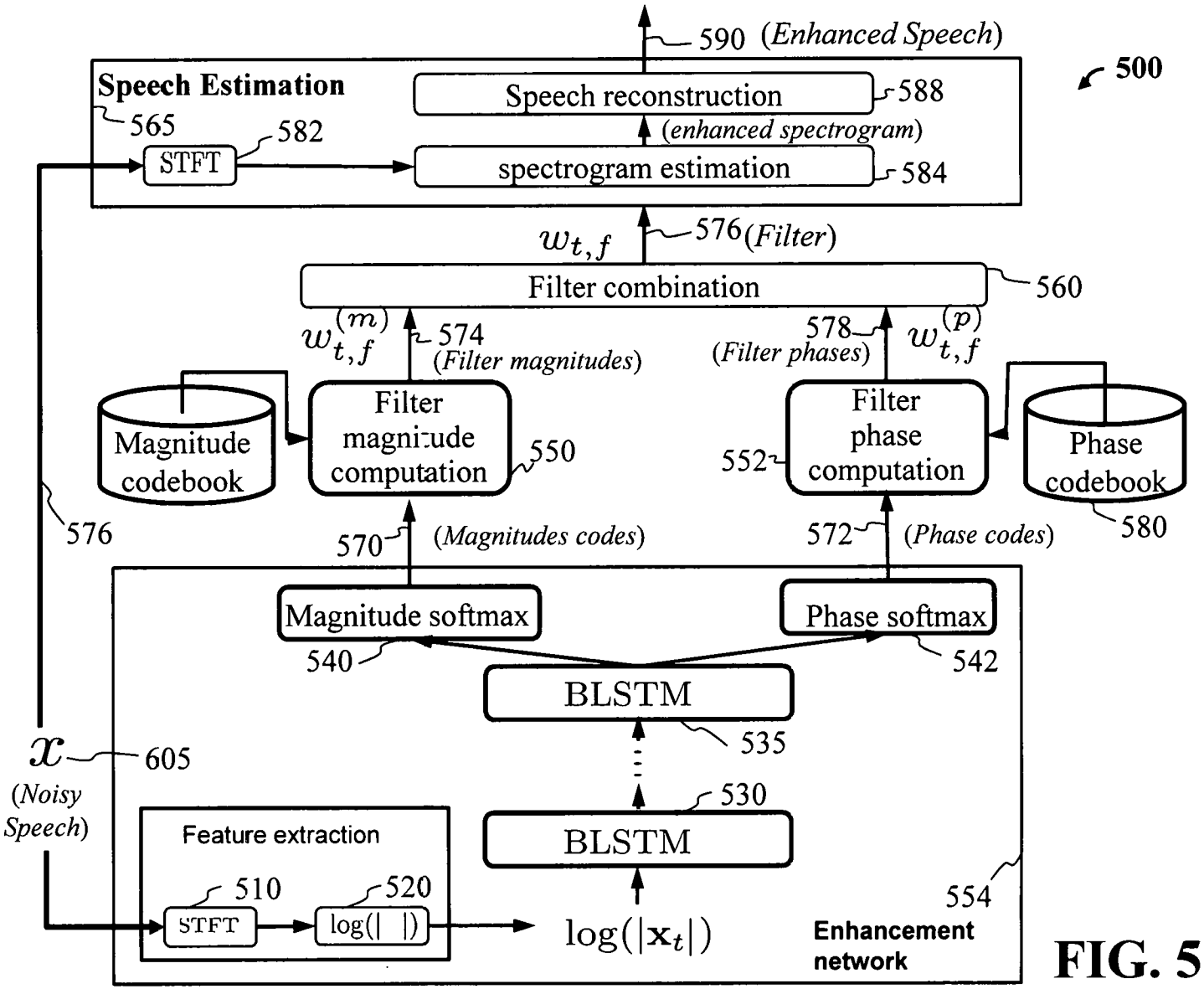
FIG. 5 is a block diagram illustrating a network architecture for speech enhancement, according to embodiments of the present disclosure.

FIG. 5 is a block diagram illustrating a network architecture 500 for speech enhancement, according to embodiments of the present disclosure. A sequence of feature vectors obtained from the input noisy speech 505, for example the log magnitude 520 of the short-time Fourier transform 510 of the input mixture, is used as input to a series of layers within an enhancement network 554. For example, the dimension of the input vector in the sequence can be F. The enhancement network can include multiple bidirectional long short-term memory (BLSTM) neural network layers, from the first BLSTM layer 530 to the last BLSTM layer 535. Each BLSTM layer is composed of a forward long short-term memory (LSTM) layer and a backward LSTM layer, whose outputs are combined and used as input by the next layer. For example, the dimension of the output of each LSTM in the first BLSTM layer 530 can be N, and both the input and output dimensions of each LSTM in all other BLSTM layers including the last BLSTM layer 535 can be N. The output of the last BLSTM layer 535 can be used as input to a magnitude softmax layer 540 and a phase softmax 542. For each time frame and each frequency in a time-frequency domain, for example the short-time Fourier transform domain, the magnitude softmax layer 540 uses output of the last BLSTM layer 535 to output $I^{(m)}$ non-negative numbers summing up to 1, where $I^{(m)}$ is the number of values in the magnitude codebook 576, and these $I^{(m)}$ numbers represent probabilities that the corresponding value in the magnitude codebook should be selected as the filter magnitude 574. A filter magnitude computation module 550 can use these probabilities as a plurality of weighted magnitude codes 570 to combine multiple values in the magnitude codebook 576 in a weighted fashion, or it can use only the largest probability as a unique magnitude code 570 to select the corresponding value in the magnitude codebook 576, or it can use a single value sampled according to these probabilities as a unique magnitude code 570 to select the corresponding value in the magnitude codebook 576, among multiple ways of using the output of the enhancement network 554 to obtain a filter magnitude 574. For each time frame and each frequency in a time-frequency domain, for example the short-time Fourier transform domain, the phase softmax layer 542 uses output of the last BLSTM layer 535 to output $I^{(p)}$ non-negative numbers summing up to 1, where $I^{(p)}$ is the number of values in the phase codebook 580, and these $I^{(p)}$ numbers represent probabilities that the corresponding value in the phase codebook should be selected as the filter phase 578. A filter phase computation module 552 can use these probabilities as a plurality of weighted phase codes 572 to combine multiple values in the phase codebook 580 in a weighted fashion, or it can use only the largest probability as a unique phase code 572 to select the corresponding value in the phase codebook 580, or it can use a single value sampled according to these probabilities as a unique phase code 572 to select the corresponding value in the phase codebook 580, among multiple ways of using the output of the enhancement network 554 to obtain a filter phase 578. A filter combination module 560 combines the filter magnitudes 574 and the filter phases 578, for example by multiplying them, to obtain a filter 576. A speech estimation module 565 uses a spectrogram estimation module 584 to process the filter 576 together with a time-frequency representation of the noisy speech 505 such as the short-time Fourier transform 582, for example by multiplying them with each other, to obtain an enhanced spectrogram, which is inverted in a speech reconstruction module 588 to obtain an enhanced speech 590.

Features

According to aspects of the present disclosure, the combinations of the phase values and the magnitude ratio values can minimize an estimation error between training enhanced speech and corresponding training target speech.

Figure 6A:
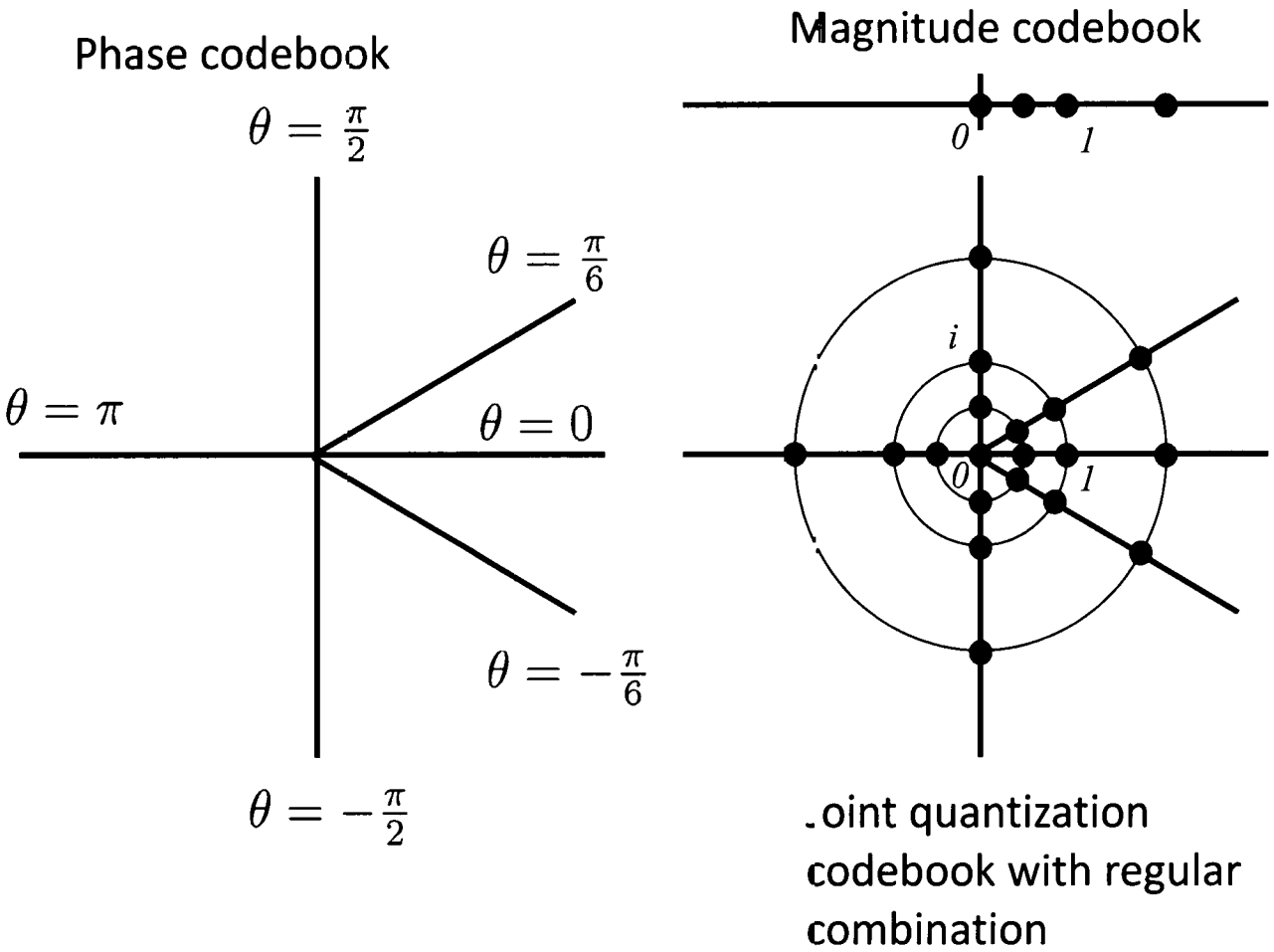
FIG. 6A is illustrating a joint quantization codebook in the complex domain regularly combining a phase quantization codebook and a magnitude quantization codebook.

Another aspect of the present disclosure can include the phase values and the magnitude ratio values being combined regularly and fully such that each phase value in the joint quantization codebook forms a combination with each magnitude ratio value in the joint quantization codebook. This is illustrated in FIG. 6A, which shows a phase codebook with six values, a magnitude codebook with four values, and a joint quantization codebook with regular combination in the complex domain where the set of complex values in the joint quantization codebook is equal to the set of values of the form $me^{i\theta}$ for all values m in the magnitude codebook and all values θ in the phase codebook.

Figure 6B:
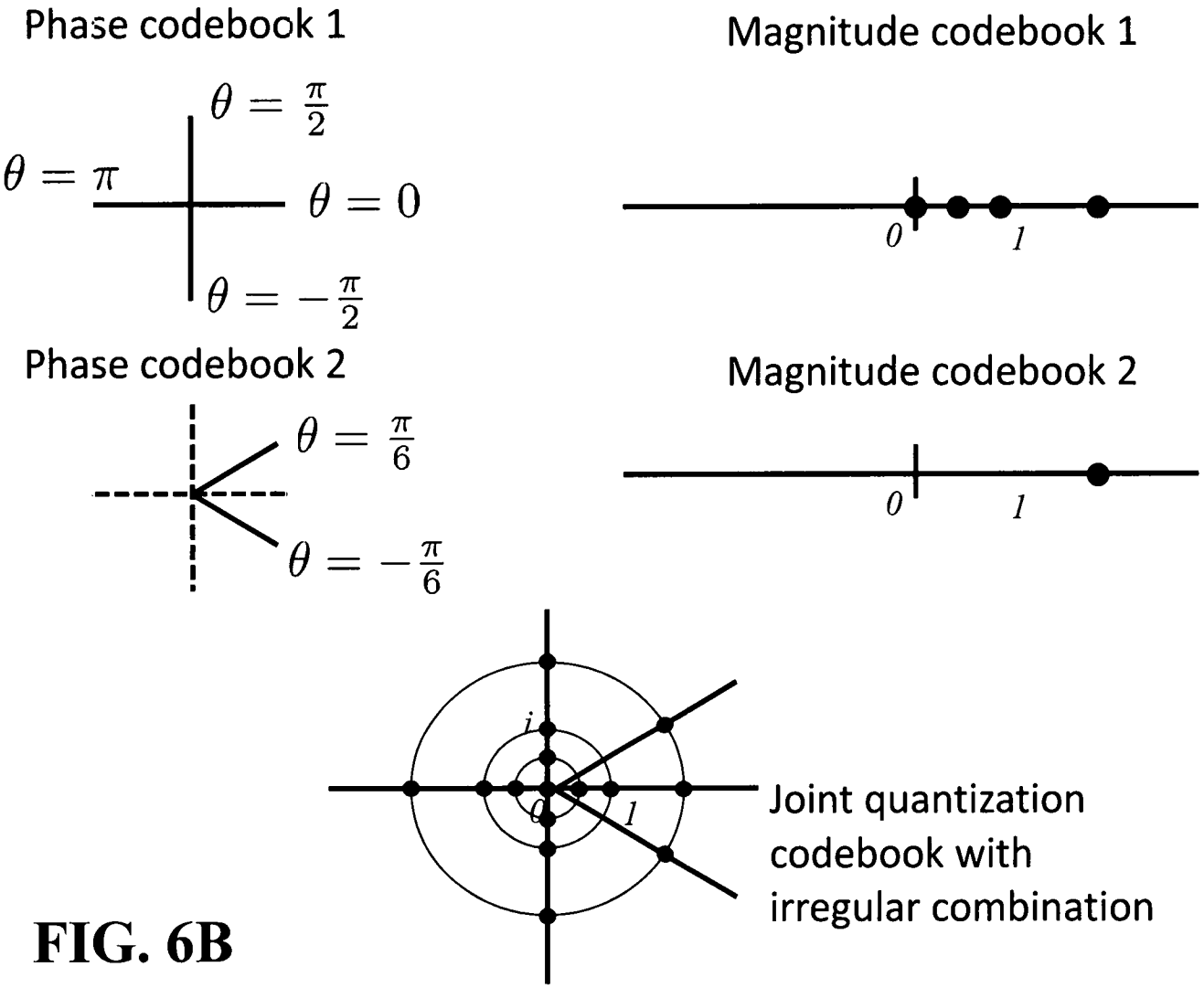
FIG. 6B is illustrating a joint quantization codebook in the complex domain irregularly combining phase and magnitude values such that the joint quantization codebook can be described as the union of two joint quantization codebooks each regularly combining a phase quantization codebook and a magnitude quantization codebook.
Figure 6C:
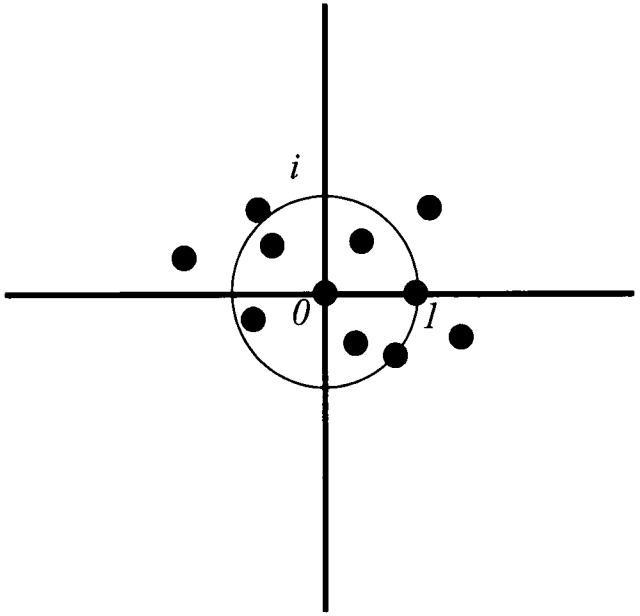
FIG. 6C is illustrating a joint quantization codebook in the complex domain irregularly combining phase and magnitude values such that the joint quantization codebook is most easily described as a set of points in the complex domains, where the points do not necessarily share a phase or magnitude component with each other.

Further, the phase values and the magnitude ratio values can be combined irregularly such that the joint quantization codebook includes a first magnitude ratio value forming combinations with a first set of phase values and includes a second magnitude ratio value forming combinations with a second set of phase values, wherein the first set of phase values differs from the second set of phase values. This is illustrated in FIG. 6B, which shows a joint quantization codebook with irregular combination in the complex domain, where the set of values in the joint quantization codebook is equal to the union of the set of values of the form $m_1e^{i\theta_1}$ for all values $m_1$ in the magnitude codebook 1 and all values $\theta_1$ in the phase codebook 1, with the set of values of the form $m_2e^{i\theta_2}$ for all values $m_2$ in the magnitude codebook 2 and all values $\theta_2$ in the phase codebook 2. More generally, FIG. 6C illustrates a joint quantization codebook with a set of K complex values $w_k$ where $w_k=m_ke^{i\theta_k}$ and $m_k$ is the unique value of a k-th magnitude codebook and $\theta_k$ is the unique value of a k-th phase codebook.

Another aspect of the present disclosure can include one of the one or more phase-related values represents an approximate value of the phase of a target signal in each time-frequency bin. Further, another aspect can be that one of the one or more phase-related values represents an approximate difference between the phase of a target signal in each time-frequency bin and a phase of the noisy audio signal in the corresponding time-frequency bin.

It is possible that one of the one or more phase-related values represents an approximate difference between the phase of a target signal in each time-frequency bin and the phase of a target signal in a different time-frequency bin. Wherein the different phase-related values are combined using phase-related-value weights. Such that, the phase-related-value weights are estimated for each time-frequency bin. This estimation can be performed by the network, or it can be performed offline by estimating the best combination according to some performance criterion on some training data.

Another aspect can include the one or more phase-related values in the one or more phase quantization codebook minimize an estimation error between a training enhanced audio signal and a corresponding training target audio signal.

Another aspect can include the encoder includes parameters that determine the mappings of the time-frequency bins to the one or more phase-related values in the one or more phase quantization codebook. Wherein, given a predetermined set of phase values for the one or more phase quantization codebook, the parameters of the encoder are optimized so as to minimize an estimation error between training enhanced audio signal and corresponding training target audio signal. Wherein the phase values of the first quantization codebook are optimized together with the parameters of the encoder in order to minimize an estimation error between training enhanced audio signal and corresponding training target audio signal. Another aspect can include that at least one magnitude ratio value can be greater than one.

Another aspect can include the encoder that maps each time-frequency bin of the noisy speech to a magnitude ratio value from a magnitude quantization codebook of magnitude ratio values indicative of quantized ratios of magnitudes of the target audio signal to magnitudes of the noisy audio signal. Wherein the magnitude quantization codebook includes multiple magnitude ratio values including at least one magnitude ratio value greater than one. It is possible to further comprise a memory to store the first quantization codebook and the second quantization codebook, and to store a neural network trained to process the noisy audio signal to produce a first index of the phase value in the phase quantization codebook and a second index of the magnitude ratio value in the magnitude quantization codebook. Wherein the encoder determines the first index and the second index using the neural network, and retrieves the phase value from the memory using the first index, and retrieves the magnitude ratio value from the memory using the second index. Wherein the combinations of the phase values and the magnitude ratio values are optimized together with the parameters of the encoder in order to minimize an estimation error between training enhanced speech and corresponding training target speech. Wherein the first quantization codebook and the second quantization codebook form a joint quantization codebook with combinations of the phase values and the magnitude ratio values, such that the encoder maps each time-frequency bin of the noisy speech to the phase value and the magnitude ratio value forming a combination in the joint quantization codebook. Wherein the phase values and the magnitude ratio values are combined such that the joint quantization codebook includes a subset of all possible combinations of phase values and magnitude ratio values. Such that the phase values and the magnitude ratio values are combined, such that the joint quantization codebook includes all possible combinations of phase values and magnitude ratio values.

An aspect further includes a processor to update time-frequency coefficients of the filter using the phase values and the magnitude ratio values determined by the encoder for each time-frequency bin and to multiply the time-frequency coefficients of the filter with a time-frequency representation of the noisy audio signal to produce a time-frequency representation of the enhanced audio signal.

Another aspect can include a processor to update time-frequency coefficients of the filter using the phase values and the magnitude ratio values determined by the encoder for each time-frequency bin and to multiply the time-frequency coefficients of the filter with a time-frequency representation of the noisy audio signal to produce a time-frequency representation of the enhanced audio signal.

Figure 7A:
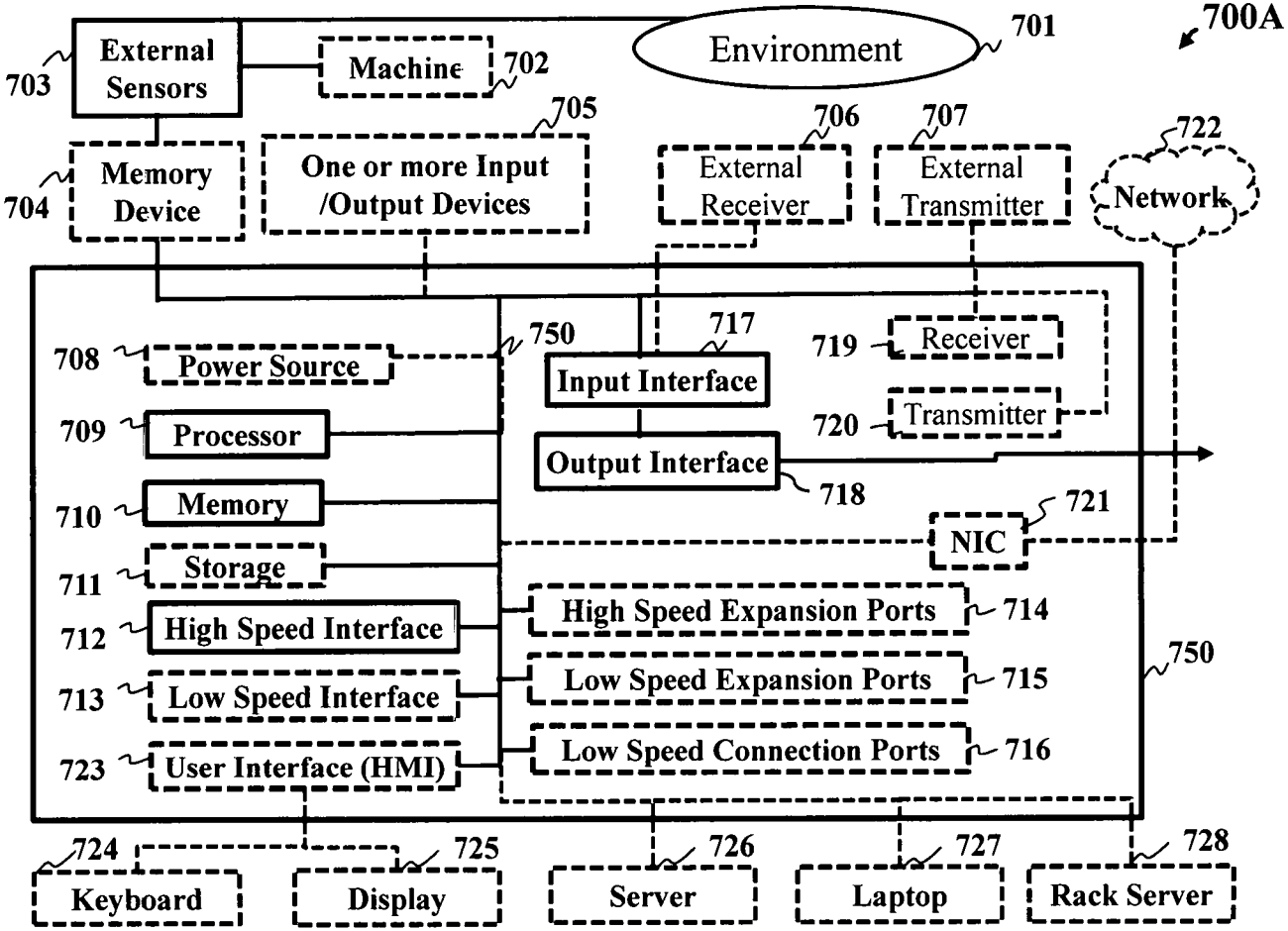
FIG. 7A is a schematic illustrating a computing apparatus that can be used to implement some techniques of the methods and systems, according to embodiments of the present disclosure.

FIG. 7A is a schematic illustrating by non-limiting example a computing apparatus 700A that can be used to implement some techniques of the methods and systems, according to embodiments of the present disclosure. The computing apparatus or device 700A represents various forms of digital computers, such as laptops, desktops, workstations, personal digital assistants, servers, blade servers, mainframes, and other appropriate computers. There can be a mother board or some other main aspect 750 of the computing device 700A of FIG. 7A.

The computing device 700A can include a power source 708, a processor 709, a memory 710, a storage device 711, all connected to a bus 750. Further, a high-speed interface 712, a low-speed interface 713, high-speed expansion ports 714 and low speed connection ports 715, can be connected to the bus 750. Also, a low-speed expansion port 716 is in connection with the bus 750.

Contemplated are various component configurations that may be mounted on a common motherboard depending upon the specific application. Further still, an input interface 717 can be connected via bus 750 to an external receiver 706 and an output interface 718. A receiver 719 can be connected to an external transmitter 707 and a transmitter 720 via the bus 750. Also connected to the bus 750 can be an external memory 704, external sensors 703, machine(s) 702 and an environment 701. Further, one or more external input/output devices 705 can be connected to the bus 750. A network interface controller (NIC) 721 can be adapted to connect through the bus 750 to a network 722, wherein data or other data, among other things, can be rendered on a third party display device, third party imaging device, and/or third party printing device outside of the computer device 700A.

Contemplated also is that the memory 710 can store instructions that are executable by the computer device 700A, historical data, and any data that can be utilized by the methods and systems of the present disclosure. The memory 710 can include random access memory (RAM), read only memory (ROM), flash memory, or any other suitable memory systems. The memory 710 can be a volatile memory unit or units, and/or a non-volatile memory unit or units. The memory 710 may also be another form of computer-readable medium, such as a magnetic or optical disk.

Still referring to FIG. 7A, a storage device 711 can be adapted to store supplementary data and/or software modules used by the computer device 700A. For example, the storage device 711 can store historical data and other related data as mentioned above regarding the present disclosure. Additionally, or alternatively, the storage device 711 can store historical data similar to data as mentioned above regarding the present disclosure. The storage device 711 can include a hard drive, an optical drive, a thumb-drive, an array of drives, or any combinations thereof. Further, the storage device 711 can contain a computer-readable medium, such as a floppy disk device, a hard disk device, an optical disk device, or a tape device, a flash memory or other similar solid state memory device, or an array of devices, including devices in a storage area network or other configurations. Instructions can be stored in an information carrier. The instructions, when executed by one or more processing devices (for example, processor 709), perform one or more methods, such as those described above.

The system can be linked through the bus 750 optionally to a display interface or user Interface (HMI) 723 adapted to connect the system to a display device 725 and keyboard 724, wherein the display device 725 can include a computer monitor, camera, television, projector, or mobile device, among others.

Still referring to FIG. 7A, the computer device 700A can include a user input interface 717 adapted to a printer interface (not shown) can also be connected through bus 750 and adapted to connect to a printing device (not shown), wherein the printing device can include a liquid inkjet printer, solid ink printer, large-scale commercial printer, thermal printer, UV printer, or dye-sublimation printer, among others.

The high-speed interface 712 manages bandwidth-intensive operations for the computing device 700A, while the low-speed interface 713 manages lower bandwidth-intensive operations. Such allocation of functions is an example only. In some implementations, the high-speed interface 712 can be coupled to the memory 710, a user interface (HMI) 723, and to a keyboard 724 and display 725 (e.g., through a graphics processor or accelerator), and to the high-speed expansion ports 714, which may accept various expansion cards (not shown) via bus 750. In the implementation, the low-speed interface 713 is coupled to the storage device 711 and the low-speed expansion port 715, via bus 750. The low-speed expansion port 715, which may include various communication ports (e.g., USB, Bluetooth, Ethernet, wireless Ethernet) may be coupled to one or more input/output devices 705, and other devices a keyboard 724, a pointing device (not shown), a scanner (not shown), or a networking device such as a switch or router, e.g., through a network adapter.

Still referring to FIG. 7A, the computing device 700A may be implemented in a number of different forms, as shown in the figure. For example, it may be implemented as a standard server 726, or multiple times in a group of such servers. In addition, it may be implemented in a personal computer such as a laptop computer 727. It may also be implemented as part of a rack server system 728. Alternatively, components from the computing device 700A may be combined with other components in a mobile device (not shown), such as a mobile computing device 700B. Each of such devices may contain one or more of the computing device 800A and the mobile computing device 700B, and an entire system may be made up of multiple computing devices communicating with each other.

Figure 7B:
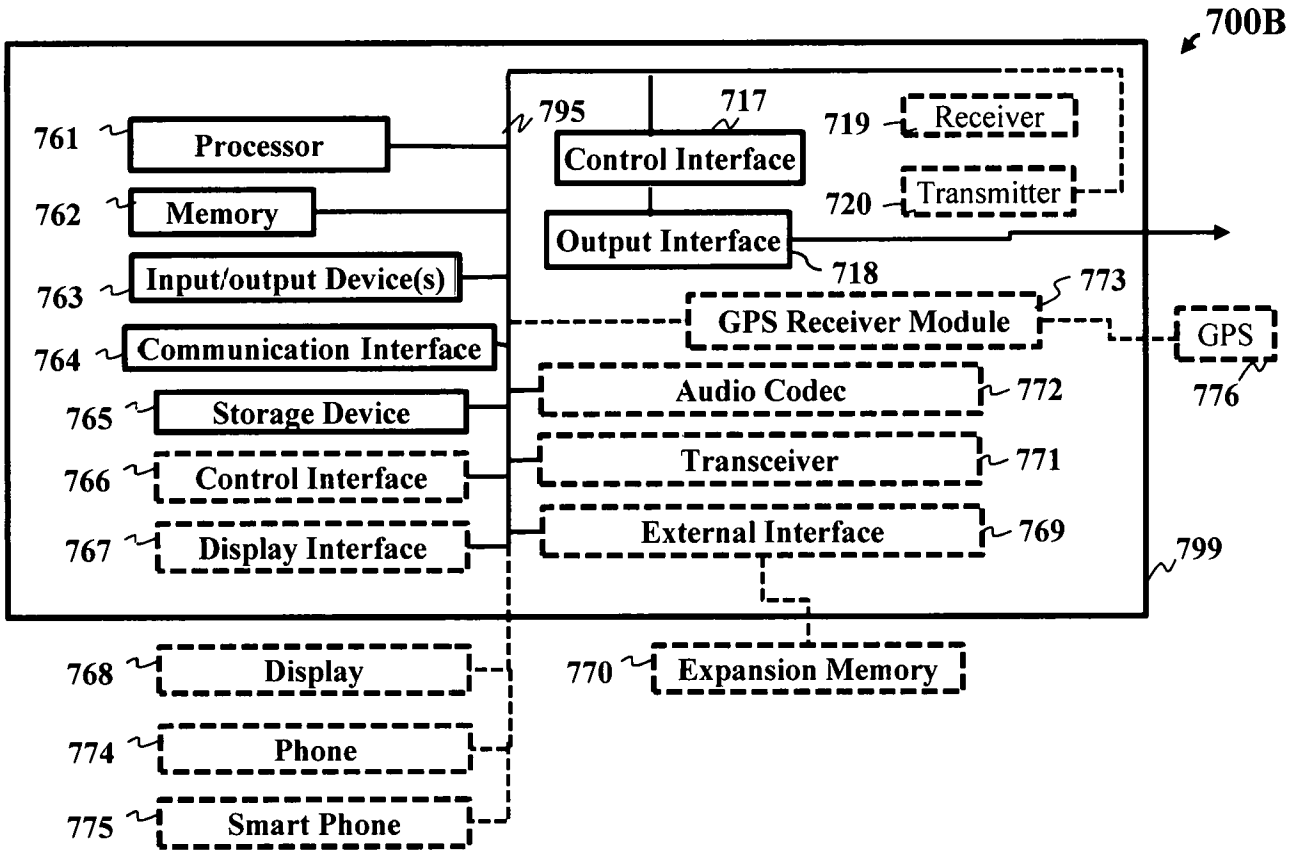
FIG. 7B is a schematic illustrating a mobile computing apparatus that can be used to implement some techniques of the methods and systems, according to embodiments of the present disclosure.

FIG. 7B is a schematic illustrating a mobile computing apparatus that can be used to implement some techniques of the methods and systems, according to embodiments of the present disclosure. The mobile computing device 700B includes a bus 795 connecting a processor 761, a memory 762, an input/output device 763, a communication interface 764, among other components. The bus 795 can also be connected to a storage device 765, such as a micro-drive or other device, to provide additional storage. There can be a mother board or some other main aspect 799 of the computing device 700B of FIG. 7B.

Referring to FIG. 7B, the processor 761 can execute instructions within the mobile computing device 700B, including instructions stored in the memory 762. The processor 761 may be implemented as a chipset of chips that include separate and multiple analog and digital processors. The processor 761 may provide, for example, for coordination of the other components of the mobile computing device 700B, such as control of user interfaces, applications run by the mobile computing device 700B, and wireless communication by the mobile computing device 700B.

The processor 761 may communicate with a user through a control interface 766 and a display interface 767 coupled to the display 768. The display 768 may be, for example, a TFT (Thin-Film-Transistor Liquid Crystal Display) display or an OLED (Organic Light Emitting Diode) display, or other appropriate display technology. The display interface 767 may comprise appropriate circuitry for driving the display 768 to present graphical and other information to a user. The control interface 766 may receive commands from a user and convert them for submission to the processor 761. In addition, an external interface 769 may provide communication with the processor 761, so as to enable near area communication of the mobile computing device 700B with other devices. The external interface 769 may provide, for example, for wired communication in some implementations, or for wireless communication in other implementations, and multiple interfaces may also be used.

Still referring to FIG. 7B, the memory 762 stores information within the mobile computing device 700B. The memory 762 can be implemented as one or more of a computer-readable medium or media, a volatile memory unit or units, or a non-volatile memory unit or units. An expansion memory 770 may also be provided and connected to the mobile computing device 700B through an expansion interface 769, which may include, for example, a SIMM (single in line memory module) card interface. The expansion memory 770 may provide extra storage space for the mobile computing device 700B, or may also store applications or other information for the mobile computing device 700B. Specifically, the expansion memory 770 may include instructions to carry out or supplement the processes described above, and may include secure information also. Thus, for example, the expansion memory 770 may be providing as a security module for the mobile computing device 700B, and may be programmed with instructions that permit secure use of the mobile computing device 700B. In addition, secure applications may be provided via the SIMM cards, along with additional information, such as placing identifying information on the SIMM card in a non-hackable manner.

The memory 762 may include, for example, flash memory and/or NVRAM memory (non-volatile random access memory), as discussed below. In some implementations, instructions are stored in an information carrier, that the instructions, when executed by one or more processing devices (for example, processor 761), perform one or more methods, such as those described above. The instructions can also be stored by one or more storage devices, such as one or more computer or machine readable mediums (for example, the memory 762, the expansion memory 770, or memory on the processor 762). In some implementations, the instructions can be received in a propagated signal, for example, over the transceiver 771 or the external interface 769.

FIG. 7B is a schematic illustrating a mobile computing apparatus that can be used to implement some techniques of the methods and systems, according to embodiments of the present disclosure. The mobile computing apparatus or device 700B is intended to represent various forms of mobile devices, such as personal digital assistants, cellular telephones, smart-phones, and other similar computing devices. The mobile computing device 700B may communicate wirelessly through the communication interface 764, which may include digital signal processing circuitry where necessary. The communication interface 764 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 771 using a radio-frequency. In addition, short-range communication may occur, such as using a Bluetooth, WiFi, or other such transceiver (not shown). In addition, a GPS (Global Positioning System) receiver module 773 may provide additional navigation and location related wireless data to the mobile computing device 700B, which may be used as appropriate by applications running on the mobile computing device 700B.

The mobile computing device 700B may also communicate audibly using an audio codec 772, which may receive spoken information from a user and convert it to usable digital information. The audio codec 772 may likewise generate audible sound for a user, such as through a speaker, e.g., in a handset of the mobile computing device 700B. Such sound may include sound from voice telephone calls, may include recorded sound (e.g., voice messages, music files, etc.) and may also include sound generated by applications operating on the mobile computing device 700B.

Still referring to FIG. 7B, the mobile computing device 700B may be implemented in a number of different forms, as shown in the figure. For example, it may be implemented as a cellular telephone 774. It may also be implemented as part of a smart-phone 775, personal digital assistant, or other similar mobile device.

Embodiments

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

Specific details are given in the following description to provide a thorough understanding of the embodiments. However, understood by one of ordinary skill in the art can be that the embodiments may be practiced without these specific details. For example, systems, processes, and other elements in the subject matter disclosed may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicated like elements.

Also, individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but may have additional steps not discussed or included in a figure. Furthermore, not all operations in any particularly described process may occur in all embodiments. A process may correspond to a method, a function, a procedure, a subroutine, a subprogram, etc. When a process corresponds to a function, the function's termination can correspond to a return of the function to the calling function or the main function.

Furthermore, embodiments of the subject matter disclosed may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Further, embodiments of the present disclosure and the functional operations described in this specification can be implemented in digital electronic circuitry, in tangibly-embodied computer software or firmware, in computer hardware, including the structures disclosed in this specification and their structural equivalents, or in combinations of one or more of them. Further some embodiments of the present disclosure can be implemented as one or more computer programs, i.e., one or more modules of computer program instructions encoded on a tangible non transitory program carrier for execution by, or to control the operation of, data processing apparatus. Further still, program instructions can be encoded on an artificially generated propagated signal, e.g., a machine-generated electrical, optical, or electromagnetic signal, that is generated to encode information for transmission to suitable receiver apparatus for execution by a data processing apparatus. The computer storage medium can be a machine-readable storage device, a machine-readable storage substrate, a random or serial access memory device, or a combination of one or more of them.

According to embodiments of the present disclosure the term "data processing apparatus" can encompass all kinds of apparatus, devices, and machines for processing data, including by way of example a programmable processor, a computer, or multiple processors or computers. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, or a combination of one or more of them.

A computer program (which may also be referred to or described as a program, software, a software application, a module, a software module, a script, or code) can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a communication network. Computers suitable for the execution of a computer program include, by way of example, can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device, e.g., a universal serial bus (USB) flash drive, to name just a few.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

Although the present disclosure has been described with reference to certain preferred embodiments, it is to be understood that various other adaptations and modifications can be made within the spirit and scope of the present disclosure. Therefore, it is the aspect of the append claims to cover all such variations and modifications as come within the true spirit and scope of the present disclosure.

What is claimed is:

1. An audio signal processing system, comprising:

an input interface to receive a noisy audio signal including a mixture of a target audio signal and noise;

an encoder to map each time-frequency bin of the noisy audio signal to one or more phase-related values from one or more phase quantization codebooks of phase-related values indicative of the phase of the target signal, and to calculate, for each time-frequency bin of the noisy audio signal, a magnitude ratio value indicative of a ratio of a magnitude of the target audio signal to a magnitude of the noisy audio signal;

a filter to cancel the noise from the noisy audio signal based on the one or more phase-related values and the magnitude ratio values to produce an enhanced audio signal; and an output interface to output the enhanced audio signal.

2. The audio signal processing system of claim 1, wherein one of the one or more phase-related values represents an approximate value of the phase of a target signal in each time-frequency bin.

3. The audio signal processing system of claim 1, wherein one of the one or more phase-related values represents an approximate difference between the phase of a target signal in each time-frequency bin and a phase of the noisy audio signal in the corresponding time-frequency bin.

4. The audio signal processing system of claim 1, wherein one of the one or more phase-related values represents an approximate difference between the phase of a target signal in each time-frequency bin and the phase of a target signal in a different time-frequency bin.

5. The audio signal processing system of claim 1, further comprising a phase-related-value weights estimator, wherein the phase-related-value weights estimator estimates phase-related-value weights for each time-frequency bin, and the phase-related-value weights are used to combine the different phase-related values.

6. The audio signal processing system of claim 1, wherein the encoder includes parameters that determine the mappings of the time-frequency bins to the one or more phase-related values in the one or more phase quantization codebook.

7. The audio signal processing system of claim 6, wherein, given a predetermined set of phase values for the one or more phase quantization codebook, the parameters of the encoder are optimized so as to minimize an estimation error between training enhanced audio signal and corresponding training target audio signal on a training dataset of pairs of training noisy audio signal and training target audio signal.

8. The audio signal processing system of claim 6, wherein the phase values of the first quantization codebook are optimized together with the parameters of the encoder in order to minimize an estimation error between training enhanced audio signal and corresponding training target audio signal on a training dataset of pairs of training noisy audio signal and training target audio signal.

9. The audio signal processing system of claim 1, wherein the encoder maps each time-frequency bin of the noisy speech to a magnitude ratio value from a magnitude quantization codebook of magnitude ratio values indicative of quantized ratios of magnitudes of the target audio signal to magnitudes of the noisy audio signal.

10. The audio signal processing system of claim 9, wherein the magnitude quantization codebook includes multiple magnitude ratio values including at least one magnitude ratio value greater than one.

11. The audio signal processing system of claim 9, further comprising:

a memory to store the first quantization codebook and the second quantization codebook, and to store a neural network trained to process the noisy audio signal to produce a first index of the phase value in the phase quantization codebook and a second index of the magnitude ratio value in the magnitude quantization codebook, wherein the encoder determines the first index and the second index using the neural network, and retrieves the phase value from the memory using the first index, and retrieves the magnitude ratio value from the memory using the second index.

12. The audio signal processing system of claim 9, wherein the phase values and the magnitude ratio values are optimized together with the parameters of the encoder in order to minimize an estimation error between training enhanced speech and corresponding training target speech.

13. The audio signal processing system of claim 9, wherein the first quantization codebook and the second quantization codebook form a joint quantization codebook with combinations of the phase values and the magnitude ratio values, such that the encoder maps each time-frequency bin of the noisy speech to the phase value and the magnitude ratio value forming a combination in the joint quantization codebook.

14. The audio signal processing system of claim 13, wherein the phase values and the magnitude ratio values are combined such that the joint quantization codebook includes a subset of all possible combinations of phase values and magnitude ratio values.

15. The audio signal processing system of claim 13, wherein the phase values and the magnitude ratio values are combined, such that the joint quantization codebook includes all possible combinations of phase values and magnitude ratio values.

16. A method for audio signal processing that includes a hardware processor coupled with a memory, wherein the memory has stored instructions and other data, the method comprising:

accepting by an input interface, a noisy audio signal including a mixture of target audio signal and noise;

mapping by the hardware processor, each time-frequency bin of the noisy audio signal to one or more phase-related values from one or more phase quantization codebook of phase-related values indicative of the phase of the target signal;

calculating by the hardware processor, for each time-frequency bin of the noisy audio signal, a magnitude ratio value indicative of a ratio of a magnitude of the target audio signal to a magnitude of the noisy audio signal;

cancelling using a filter, the noise from the noisy audio signal based on the phase values and the magnitude ratio values to produce an enhanced audio signal; and outputting by an output interface, the enhanced audio signal.

17. The method of claim 16, wherein the cancelling further comprising:

updating time-frequency coefficients of the filter using the one or more phase values and the magnitude ratio values determined by the hardware processor for each time-frequency bin and to multiply the time-frequency coefficients of the filter with a time-frequency representation of the noisy audio signal to produce a time-frequency representation of the enhanced audio signal.

18. The method of claim 16, wherein the stored other data includes a first quantization codebook, a second quantization codebook, and a neural network trained to process the noisy audio signal to produce a first index of the phase value in the first quantization codebook and a second index of the magnitude ratio value in the second quantization codebook, wherein the hardware processor determines the first index and the second index using the neural network, and retrieves the phase value from the memory using the first index, and retrieves the magnitude ratio value from the memory using the second index.

19. The method of claim 18, wherein the first quantization codebook and the second quantization codebook form a joint quantization codebook with combinations of the phase values and the magnitude ratio values, such that the hardware processor maps each time-frequency bin of the noisy speech to the phase value and the magnitude ratio value forming a combination in the joint quantization codebook.

20. A non-transitory computer readable storage medium embodied thereon a program executable by a hardware processor for performing a method, the method comprising:

accepting a noisy audio signal including a mixture of target audio signal and noise;

mapping each time-frequency bin of the noisy audio signal to a phase value from a first quantization codebook of phase values indicative of quantized phase differences between phases of the noisy audio signal and phases of the target audio signal;

mapping by the hardware processor, each time-frequency bin of the noisy audio signal to one or more phase-related values from one or more phase quantization codebook of phase-related values indicative of the phase of the target signal;

calculating by the hardware processor, for each time-frequency bin of the noisy audio signal, a magnitude ratio value indicative of a ratio of a magnitude of the target audio signal to a magnitude of the noisy audio signal;

cancelling using a filter, the noise from the noisy audio signal based on the phase values and the magnitude ratio values to produce an enhanced audio signal; and outputting by an output interface, the enhanced audio signal.

* * * * *